US009952538B2

(12) United States Patent
Nishida et al.

(10) Patent No.: US 9,952,538 B2
(45) Date of Patent: Apr. 24, 2018

(54) IMAGE FORMING APPARATUS WHICH CONTROLS THE TRANSFER OF TONER TO A HEATING MEMBER

(71) Applicant: CANON KABUSHIKI KAISHA, Tokyo (JP)

(72) Inventors: Satoshi Nishida, Numazu (JP); Isamu Takeda, Machida (JP); Akimichi Suzuki, Yokohama (JP); Shogo Kan, Yokohama (JP); Kazuhiro Doda, Yokohama (JP); Takanori Mitani, Meridan, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/090,993

(22) Filed: Apr. 5, 2016

(65) Prior Publication Data

US 2016/0299460 A1 Oct. 13, 2016

(30) Foreign Application Priority Data

Apr. 9, 2015 (JP) ..... 2015-080460

(51) Int. Cl.
*G03G 15/20* (2006.01)

(52) U.S. Cl.
CPC . *G03G 15/2039* (2013.01); *G03G 2215/2019* (2013.01); *G03G 2215/2035* (2013.01)

(58) Field of Classification Search
CPC ..... G03G 15/065; G03G 15/2039
USPC ..... 399/69, 67
See application file for complete search history.

(56) References Cited

U.S. PATENT DOCUMENTS

2005/0207770 A1* 9/2005 Nihonyanagi ..... G03G 15/2025 399/67
2011/0299868 A1* 12/2011 Ito ..... G03G 15/2039 399/69

FOREIGN PATENT DOCUMENTS

JP 2003-114583 A 4/2003

* cited by examiner

*Primary Examiner* — Quana M Grainger
(74) *Attorney, Agent, or Firm* — Canon USA, Inc. I.P. Division

(57) ABSTRACT

An image forming apparatus includes a fixing unit including a roller, a heating rotary member heating the roller, and a backup member forming a nip portion, a temperature detection unit detecting a temperature of the heating rotary member, and a control unit for controlling power so that the detected temperature is maintained at a target temperature, wherein a print job includes a first step in which the unfixed toner image is formed on the recording material, a second step in which fixing processing is executed, and a third step in which the fixing unit is cleaned, and wherein the third step is executed following the second step, and in the third step, while the target temperature is set higher than the target temperature in the second step, the roller and the heating rotary member are rotated in a state where no recording material is present at the nip portion.

9 Claims, 20 Drawing Sheets

IMAGE FORMING APPARATUS WHICH CONTROLS THE TRANSFER OF TONER TO A HEATING MEMBER

BACKGROUND OF THE INVENTION

Field of the Invention

The present invention relates to electrophotographic image forming apparatuses such as copying machines, printers, etc.

Description of the Related Art

Fixing devices are used in electrophotographic image forming apparatuses such as copying machines, printers, etc., and there is known a fixing device in which a fixing roller is heated from an outer peripheral surface side. In general, such a fixing device includes a fixing roller, a heating rotary member configured to be in contact with the fixing roller to heat the fixing roller, and a pressing roller configured to be in contact with the fixing roller to form a nip portion. While being conveyed, a recording material on which a toner image is formed is heated at the nip portion to fix the toner image onto the recording material. Examples of the heating rotary member of the fixing device include a heating rotary member including a cylindrical film and a heater into contact with an inner surface of the film, a heating rotary member including a heating roller containing a halogen heater, etc.

Meanwhile, in the fixing device, a phenomenon called "offset" sometimes occurs in which a part of toner on a recording material is transferred to the outer peripheral surface of the fixing roller. Hereinafter, toner that has been offset will be referred to as offset toner. As the fixing roller is rotated, the offset toner may be transferred onto a surface of the heating rotary member and accumulated on the surface of the heating rotary member. The accumulated toner may form into a mass and occasionally return to the surface of the fixing roller to contaminate a toner image on the recording material.

To solve such a problem, Japanese Patent Application Laid-Open No. 2003-114583 discusses a fixing device in which the non-tackiness of a heating member (heating rotary member), i.e., an external heating member, with respect to toner on a recording material is set higher than the non-tackiness of a fixing roller. In the fixing device, the adhesive force between the offset toner and the fixing roller is stronger than the adhesive force between the offset toner and the heating member, so that the offset toner on the fixing roller does not adhere to the heating member and is likely to remain on the surface of the fixing roller. Thus, the offset toner on the surface of the fixing roller can be fixed onto the recording material and discharged as the fixing roller rotates.

However, it is not sometimes sufficient to give a mere difference between the non-tackiness of the external heating member and the non-tackiness of the fixing roller surface, and there still remains a problem that offset toner adheres to the external heating member.

SUMMARY OF THE INVENTION

In accordance with an aspect of the invention, an image forming apparatus for forming a toner image on a recording material includes an image forming unit configured to form an unfixed toner image on the recording material, a fixing unit configured to heat the recording material on which the unfixed toner image is formed while conveying the recording material at a nip portion to fix the unfixed toner image on the recording material, the fixing unit including a roller, a heating rotary member configured to be in contact with an outer surface of the roller to heat the roller, and a backup member configured to be in contact with a region of the outer surface of the roller to form the nip portion, the region being different from a region with which the heating rotary member is brought into contact, a temperature detection unit configured to detect a temperature of the heating rotary member, and a control unit configured to control power to be supplied to the heating rotary member so that the temperature detected by the temperature detection unit is maintained at a target temperature, wherein a print job includes a first step in which the unfixed toner image is formed on the recording material, a second step in which fixing processing is executed, and a third step in which the fixing unit is cleaned, and wherein the third step is executed following the second step, and in the third step, while the target temperature is set higher than the target temperature in the second step, the roller and the heating rotary member are rotated in a state where no recording material is present at the nip portion.

Further features of the present invention will become apparent from the following description of exemplary embodiments with reference to the attached drawings.

DESCRIPTION OF THE EMBODIMENTS

(1) Image Forming Apparatus

Figure 1:
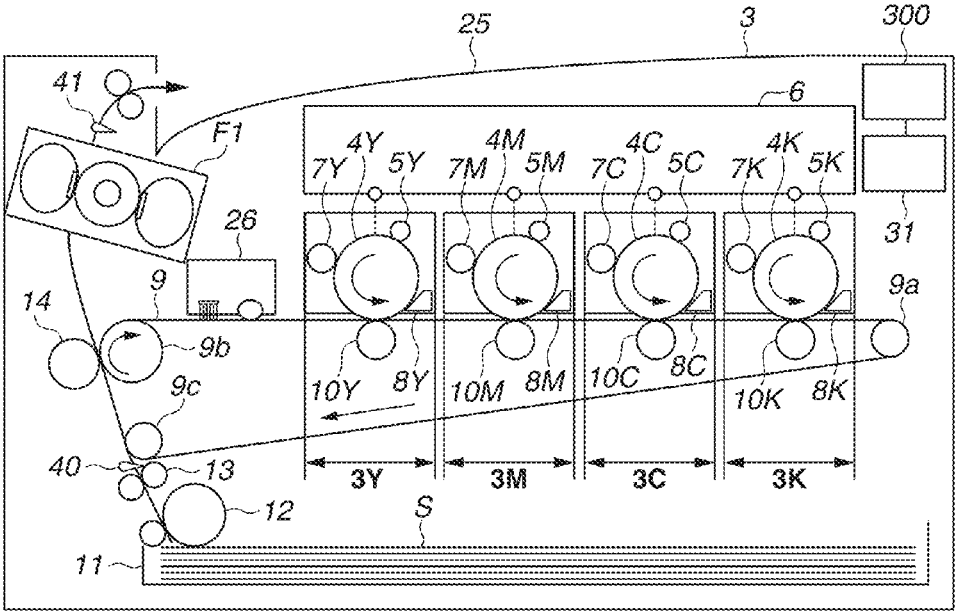
FIG. 1 is a cross-sectional view illustrating an image forming apparatus according to a first exemplary embodiment.

The following describes a first exemplary embodiment. More specifically, an image forming apparatus according to the present exemplary embodiment will be described. FIG. 1 illustrates an image forming apparatus P used in the present exemplary embodiment. The image forming apparatus P includes a conveying path 3 for conveying recording materials S and four image forming stations 3Y, 3M, 3C, and 3K arranged substantially linearly in a substantially vertical direction with respect to the conveying path 3. Among the four image forming stations 3Y, 3M, 3C, and 3K, the image forming station 3Y is an image forming station configured to form yellow (hereinafter, "Y") images. The image forming station 3M is an image forming station configured to form magenta (hereinafter, "M") images. The image forming station 3C is an image forming station configured to form cyan (hereinafter, "C") images. The image forming station 3K is an image forming station configured to form black (hereinafter, "K") images.

The image forming stations 3Y, 3M, 3C, and 3K include drum-type electrophotographic photosensitive members (hereinafter, "photosensitive drums") 4Y, 4M, 4C, and 4K, serving as image bearing members, and charging rollers 5Y, 5M, 5C, and 5K, serving as charging units, respectively. Further, the image forming stations 3Y, 3M, 3C, and 3K include an exposure device 6, serving as an exposure unit, development devices 7Y, 7M, 7C, and 7K, serving as development units, and cleaning devices 8Y, 8M, 8C, and 8K, serving as cleaning units, respectively. When a video controller 300 receives image information from an external apparatus (not illustrated) such as a host computer, etc., the video controller 300 transmits print signals to a control unit 31, and an image forming operation is started. In the image formation, the photosensitive drum 4Y rotates in the direction of an arrow in the image forming station 3Y. First, an outer peripheral surface (surface) of the photosensitive drum 4Y is uniformly charged by the charging roller 5Y, and laser light corresponding to image data is applied to the charged surface of the surface of the photosensitive drum 4Y by the exposure device 6, whereby the charged surface is exposed to form an electrostatic latent image. The latent image is visualized by the development device 7Y using Y toner to form a Y toner image. In this way, the Y toner image is formed on the surface of the photosensitive drum 4Y. A similar image formation process is performed in each of the image forming stations 3M, 3C, and 3K. Consequently, M, C, and K toner images are formed on the surfaces of the photosensitive drums 4M, 4C, and 4K, respectively.

An endless intermediate transfer belt 9 provided along the direction in which the image forming stations 3Y, 3M, 3C, and 3K are arranged is stretched around a driving roller 9*a* and driven rollers 9*b* and 9*c*. The driving roller 9*a* rotates in the direction of an arrow specified in FIG. 1. In this way, the intermediate transfer belt 9 is rotated and moved at the speed of 100 mm/sec along the image forming stations 3Y, 3M, 3C, and 3K. Primary transfer units 10Y, 10M, 10C, and 10K are disposed to face the photosensitive drums 4Y, 4M, 4C, and 4K across the intermediate transfer belt 9. The toner images of the respective colors are sequentially superimposed and transferred onto an outer peripheral surface (surface) of the intermediate transfer belt 9 by the primary transfer units 10Y, 10M, 10C, and 10K. In this way, a full-color toner image of the four colors is formed on the surface of the intermediate transfer belt 9.

Residual toner remaining on the surfaces of the photosensitive drums 4Y, 4M, 4C, and 4K after the primary transfer is removed by a cleaning blade (not illustrated) provided to each of the cleaning devices 8Y, 8M, 8C, and 8K. In this way, the photosensitive drums 4Y, 4M, 4C, and 4K are prepared for next image formation.

Recording materials S stacked and stored in a sheet feeding cassette 11 provided to a lower part of the image forming apparatus P are separately fed one by one from the sheet feeding cassette 11 by a sheet feeding roller 12 and conveyed to a pair of registration rollers 13. The pair of registration rollers 13 sends the conveyed recording material S to a transfer nip portion between the intermediate transfer belt 9 and a secondary transfer roller 14. The secondary transfer roller 14 is disposed to face the driven roller 9*b* across the intermediate transfer belt 9. Bias is applied to the secondary transfer roller 14 from a high-voltage power supply (not illustrated) when the recording material S passes through the transfer nip portion. In this way, the secondary transfer of the full-color toner image is carried out from the surface of the intermediate transfer belt 9 onto the recording material S passing through the transfer nip portion. Hereinafter, the steps up to the transfer of a toner image onto a recording material will be referred to as a transfer step (first step). Hereinafter, components for forming a toner image on a recording material S will be referred to as an image forming unit.

The recording material S on which the toner image is formed at the image forming unit is conveyed to a fixing device F1. The recording material S passes through the fixing device F1 so that the recording material S is heated and pressed to thermally fix the toner image onto the recording material S. Then, the recording material S is discharged from the fixing device F1 to a sheet discharging tray 25 outside the image forming apparatus (printer) P. Hereinafter, the step of fixing a toner image onto a recording material will be referred to as a fixing processing step (second step).

Residual toner remaining on the surface of the intermediate transfer belt 9 after the secondary transfer is removed by an intermediate transfer belt cleaning device 26. In this way, the intermediate transfer belt 9 is prepared for next image formation.

The movement of the recording material S can be detected by a top sensor 40 provided in the vicinity of the pair of registration rollers 13, and a sheet discharge sensor 41 provided between the fixing device F1 and the sheet discharging tray 25. An interval (sheet interval) between a preceding recording material S and a subsequent recording material S in continuous printing can be estimated from an interval between the time points at which the respective recording materials S pass through the top sensor 40. Further, the timing of arrival of a recording material S at the fixing device F1 and the timing of discharge of the recording material S can be estimated from the timing at which the recording material S passes through the top sensor 40 and the feed rate of the recording material S. With the sheet discharge sensor 41, the discharge of a recording material S is discharged from the fixing device F1 to the sheet discharging tray 25 can be confirmed.

(2) Fixing Device (Fixing Unit)

In the following description, with regard to the fixing device and the members included in the fixing device, a lengthwise direction refers to a direction on a plane of the recording material S that is orthogonal to the direction in which the recording material is conveyed. A widthwise direction refers to a direction on the plane of the recording material that is parallel to the direction in which the recording material S is conveyed. A length refers to a dimension in the lengthwise direction. A width refers to a dimension in the widthwise direction.

Figure 2:
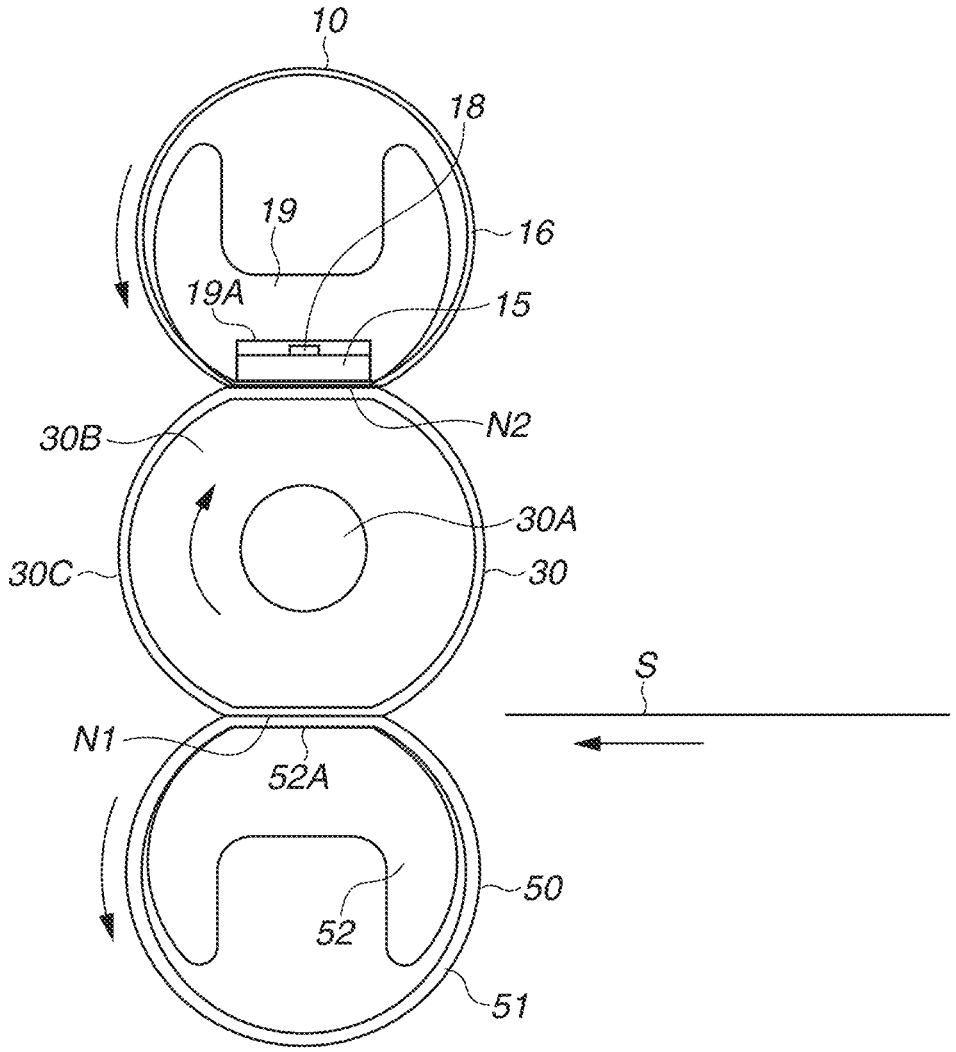
FIG. 2 is a cross-sectional view illustrating a fixing device according to the first exemplary embodiment.
Figure 3:
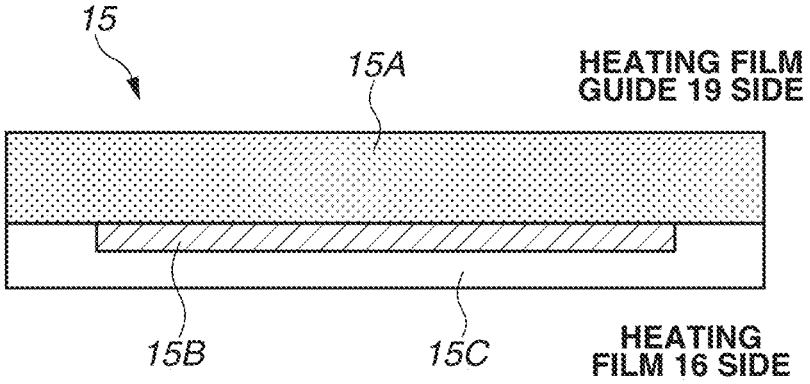
FIG. 3 is a cross-sectional view illustrating a heater according to the first exemplary embodiment.
Figure 4:
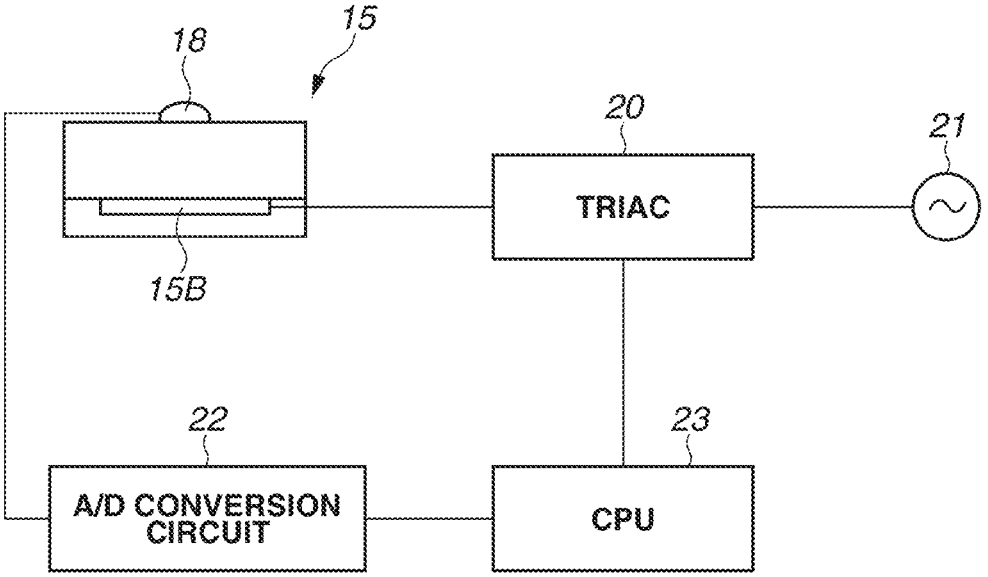
FIG. 4 illustrates a power control system configured to supply power to the heater according to the first exemplary embodiment.

FIG. 2 is a schematic cross sectional view schematically illustrating the configuration of the fixing device F1 according to the present exemplary embodiment. FIG. 3 is a schematic cross sectional view schematically illustrating the configuration of a ceramic heater (hereinafter, "heater") 15 used in of the fixing device F1 according to the present exemplary embodiment. FIG. 4 illustrates the heater 15 and a power control system. The fixing device F1 is a fixing device using an external heating method. The fixing device F1 according to the present exemplary embodiment includes a fixing roller (roller) 30, serving as a fixing rotary member, a heating unit 10, serving as a heating member, a pressing unit 50, serving as a backup member, etc. The fixing roller 30 is a member extending in the lengthwise direction.

The fixing roller 30 includes a core metal 30A. The core metal 30A is in the shape of a round shaft and made of a metal material such as iron, stainless steel (SUS), and aluminum. An elastic layer 30B containing material such as silicone rubber as a main component is formed on an outer peripheral surface of the core metal 30A, and a release layer 30C containing material such as polytetrafluoroethylene (PTFE), perfluoroalkoxy alkanes (PFA), and fluorinated ethylene propylene (FEP) as a main component is formed on an outer peripheral surface of the elastic layer 30B. Respective end portions of the core metal 30A of the fixing roller 30 in the lengthwise direction are rotatably supported by side plates (not illustrated) of an apparatus frame (not illustrated) on respective sides in the lengthwise direction via bearings (not illustrated).

The heating unit 10 includes the heater 15, serving as a heat source, a cylindrical heating film 16, serving as a heating rotary member, a heating film guide 19, serving as a first support member. The heating unit 10 is configured to be in contact with an outer surface of the fixing roller 30 and to heat the fixing roller 30. The heating film guide 19 is formed using a heat-resistant material such as a liquid crystal polymer to have a substantially U-shaped cross-section. Further, respective end portions of the heating film guide 19 in the lengthwise direction are supported by the side plates on the respective sides of the apparatus frame in the lengthwise direction. The heater 15 is supported by a groove 19A formed in a flat surface of the heating film guide 19 along the lengthwise direction of the heating film guide 19, and the heating film 16 is loosely fitted onto the heating film guide 19 supporting the heater 15. Each of the heater 15, the heating film 16, and the heating film guide 19 is a member that is long in the lengthwise direction.

The following describes the configuration of the heater 15 with reference to FIG. 3 illustrating the cross-sectional view of the heater 15. The heater 15 includes a heater substrate 15A containing a ceramic such as alumina, and aluminum nitride as a main component and having a thin-plate shape. On a substrate surface of the heater substrate 15A that is on the side close to the heating film 16, a heat generating resistor 15B containing silver and palladium as a main component is provided along the lengthwise direction of the heater substrate 15A. Further, a protection layer 15C containing glass or a heat-resistant resin such as a fluororesin, and polyimide as a main component is provided on the substrate surface to cover the heat generating resistor 15B.

The heating film 16 is formed in such a manner that the length of an inner periphery of the heating film 16 is longer by a predetermined length than the length of an outer periphery of the heating film guide 19, and the heating film 16 is loosely fitted onto the heating film guide 19 without tension. As to the layer structure of the heating film 16, a two-layer structure is employed in which an outer peripheral surface of a film base layer containing polyimide as a main component and having the shape of an endless belt is coated with a surface layer containing PFA as a main component and having the shape of an endless belt.

The heating unit 10 is disposed parallel to the fixing roller 30 on the upper side of the fixing roller 30 in FIG. 2. Respective end portions of the heating film guide 19 in the lengthwise direction are pressed against the fixing roller 30 by a pressurizing spring (not illustrated). In this way, the heater 15 is pressed against an outer surface of the fixing roller 30 via the heating film 16, whereby the heater 15 forms a heating nip portion N2 together with the fixing roller 30 via the heating film 16.

The pressing unit 50 includes a cylindrical pressing film 51, serving as a pressing rotary member, and a pressing film guide 52, serving as a second support member. The pressing film guide 52 is formed using a heat-resistant material such as a liquid crystal polymer to have a substantially U-shaped cross-section. Further, respective end portions of the pressing film guide 52 in the lengthwise direction are supported by the side plates on the respective sides of the apparatus frame in the lengthwise direction. Further, the pressing film 51 is loosely fitted onto the pressing film guide 52. Each of the pressing film 51 and the pressing film guide 52 is a member that is long in the lengthwise direction.

The pressing film 51 is formed such that the length of an inner periphery of the pressing film 51 is longer by a predetermined length than the length of an outer periphery of the pressing film guide 52, and the pressing film 51 is loosely fitted onto the pressing film guide 52 without tension. As to the layer structure of the pressing film 51, a two-layer structure is employed in which an outer peripheral surface of a film base layer containing polyimide as a main component and having the shape of an endless belt is coated with a surface layer containing PFA as a main component and having the shape of an endless belt.

The pressing unit 50 is disposed parallel to the fixing roller 30 on the lower side of the fixing roller 30 in FIG. 2. Respective end portions of the pressing film guide 52 in the lengthwise direction are biased by a pressuring spring (not illustrated) in a direction that is orthogonal to the generatrix direction of the fixing roller 30, whereby the pressing film 51 is brought into contact with (is abutted against) a surface of the fixing roller 30 in a pressed state at a flat surface 52A of the pressing film guide 52. In this way, the elastic layer 30B of the fixing roller 30 is crushed and elastically deformed at a position corresponding to the flat surface 52A of the pressing film guide 52, whereby the surface of the fixing roller 30 and the outer peripheral surface (surface) of the pressing film 51 form a nip portion N1 having a predetermined width therebetween. Accordingly, the fixing roller 30 forms the nip portion N1 together with the pressing film 51.

The following describes operations of the fixing device F1 in the fixing processing step (second step), with reference to FIGS. 2 and 4. A control unit (not illustrated) causes a driving motor (not illustrated), serving as a driving source, to rotate according to an image formation sequence executed in response to a print instruction. The rotation of an output shaft of the driving motor is transmitted to the core metal 30A of the fixing roller 30 via a predetermined gear train (not illustrated). Consequently, the fixing roller 30 rotates in the direction of an arrow at a predetermined circumferential velocity (processing speed). The rotation of the fixing roller 30 is transmitted to the pressing film 51 at the nip portion N1 by the frictional force between the surface of the fixing roller 30 and the surface of the pressing film 51. Consequently, the pressing film 51 is rotated in the direction of an arrow following the rotation of the fixing roller 30 while an inner periphery surface (inner surface) of the pressing film 51 is being in contact with the flat surface 52A of the pressing film guide 52. Further, the rotation of the fixing roller 30 is transmitted to the heating film 16 at the heating nip portion N2 by the frictional force between the surface of the fixing roller 30 and the surface of the heating film 16. Consequently, the heating film 16 is rotated in the direction of an arrow following the rotation of the fixing roller 30 while an inner periphery surface (inner surface) of the heating film 16 is being in contact with an outer surface of the protection layer 15C of the heater 15.

Further, a central processing unit (CPU) 23 illustrated in FIG. 4 turns on a triac 20 serving as a power application control unit according to the image formation sequence. The triac 20 controls power applied from an alternating current (AC) power source 21 and starts the supply of power to the heat generating resistor 15B of the heater 15. The supply of power causes the heat generating resistor 15B to generate heat so that the temperature of the heater 15 increases rapidly to heat the heating film 16. The temperature of the heater 15 is detected by a thermistor 18, which serves as a temperature detection unit provided to a substrate surface of the heater substrate 15A on the side that is close to the heating film guide 19. The CPU 23 acquires an output signal (temperature detection signal) from the thermistor 18 via an analog/digital (A/D) conversion circuit 22 and controls the triac 20 based on the output signal to maintain the heater 15 at a predetermined fixing temperature (target temperature). In this way, the temperature of the heater 15 is adjusted to the predetermined temperature.

The surface of the rotating fixing roller 30 is heated at the heating nip portion N2 by the heater 15 via the heating film 16. In this way, the surface of the fixing roller 30 can obtain an amount of heat that is sufficient to heat and fix at the nip portion N1 an unfixed toner image T borne on a recording material S. In a state where the driving motor is rotationally driven and the heater 15 is controlled, the recording material S bearing the unfixed toner image T thereon is brought to the nip portion N1 in such a manner that the surface of the recording material S, on which the toner image T is borne, faces the fixing roller 30. The recording material S is conveyed while being nipped at the nip portion N1 by the surface of the fixing roller 30 and the surface of the pressing film 51. During the conveying process, the toner image T is heated and melted on the surface of the fixing roller 30 and the nip pressure is applied to the melted toner image T by the nip portion N1, whereby the toner image T is fixed onto the surface of the recording material S. The foregoing step is the fixing processing step.

In the fixing processing step described above, at the time of fixing the toner image T onto the recording material S at the nip portion N1, a phenomenon called offset occurs in which a part of the toner on the recording material S is transferred to an outer peripheral surface (surface) of the fixing roller 30. As the fixing roller 30 rotates, the offset toner adhered to the surface of the fixing roller 30 is brought into contact with the surface of the heating film 16 at the heating nip portion N2 and also adheres to the surface of the heating film 16.

Figure 5:
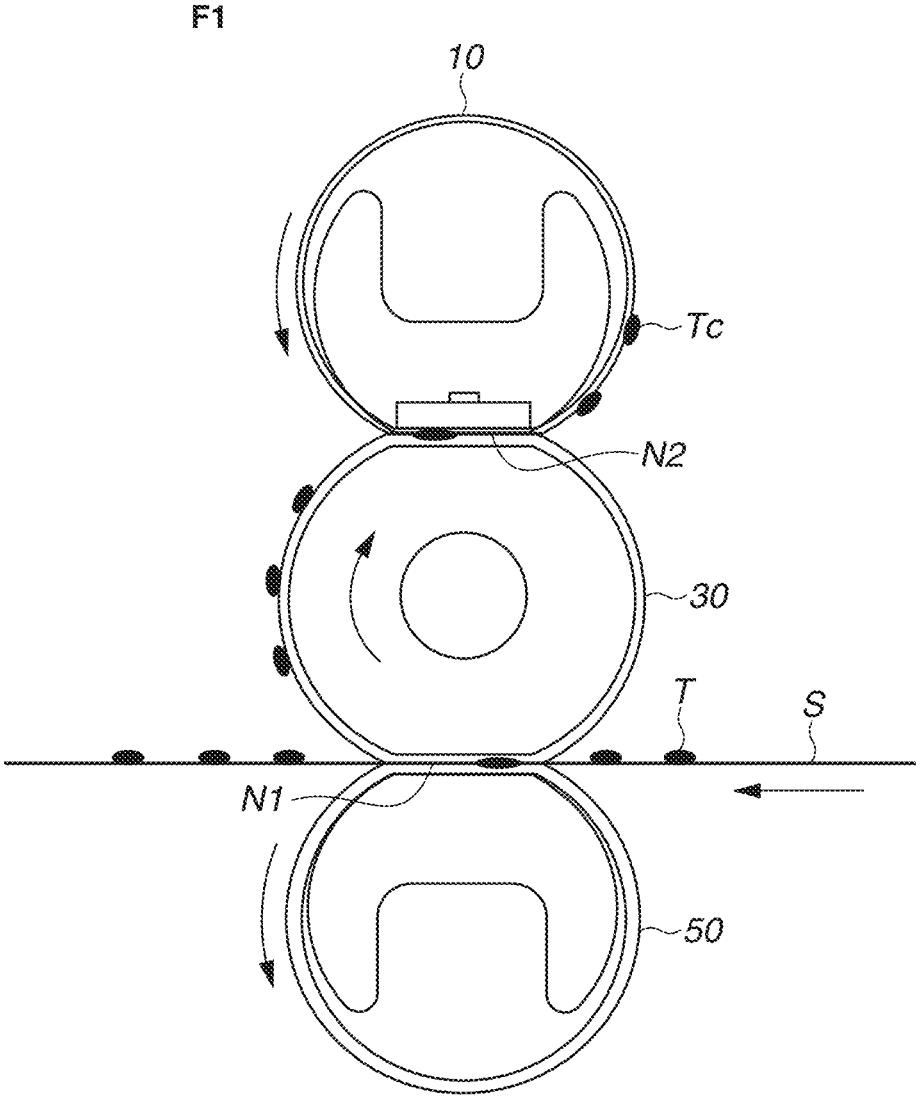
FIG. 5 illustrates a path through which contamination toner is transferred in the fixing device according to the first exemplary embodiment.

Further, paper dust contained in the recording material S, such as paper fiber, and a filler made of an inorganic material such as calcium carbonate and talc falls off and adheres to the surface of the fixing roller 30 and is also transferred to the surface of the heating film 16. The toner and the paper dust on the heating film 16 are mixed together and accumulated on the heating film 16 (refer to FIG. 5). Hereinafter, toner attached to and accumulated on the heating film 16 will be referred to as contamination toner Tc. The contamination toner Tc decreases the non-tackiness on the surface of the heating film 16 and gathers more toner and paper dust to grow further. The contamination toner Tc accumulated on the surface of the heating film 16 occasionally forms into a large mass and is transferred to the surface of the fixing roller 30 and then transferred onto a recording material S to cause a defective image.

Next, first, second, and third experiments were conducted as experiments on the cleaning of contamination toner Tc accumulated on the heating film 16.

First Experiment

An experiment was conducted using the image forming apparatus P and the fixing device F1 described in the present exemplary embodiment to confirm a condition in which the contamination toner Tc accumulated on the heating film 16 was discharged onto the recording material S. The processing speed of the image forming apparatus P used in the experiment was 100 mm/s, and the interval (sheet interval) between a preceding recording material S and a subsequent recording material S was 30 mm. The fixing device F1 is the same as the fixing device F1 used in the present exemplary embodiment, and the target temperature of the heater 15 during the fixing processing was 200° C. (T1). The following steps were conducted in the experiment.

(Step 1) A print job of continuously printing on 250 recording materials S was executed in the image forming apparatus P and the fixing device F1.

(Step 2) When the last recording material S was discharged from a fixing nip and the sheet discharge sensor 41 detected the passing of the last recording material, the fixing processing step was ended. Thereafter, while the detected temperature of the heater 15 was maintained at the predetermined target temperature, the fixing roller 30 was driven to rotate the heating film 16 and the pressing film 51. Hereinafter, the operation of rotating the fixing roller 30 while no recording material S is conveyed at the fixing nip will be referred to as idle rotation. After the idle rotation was executed for five seconds, the supply of power to the heater 15 was stopped, and then the rotation of the fixing roller 30 was stopped. Hereinafter, the foregoing step will be referred to as a cleaning step.

By a mechanism described below, the toner attached to the heating film 16 was transferred to the fixing roller 30 and was removed from the heating film 16.

Hereinafter, the step executed between the detection of the passing of the last recording material S of the print job by the sheet discharge sensor 41 and the stop of the supply of power to the heater 15 will be referred to as a cleaning step.

(Step 3) To confirm the discharge of contamination toner Tc, one recording material S on which no drawing was performed to attach no toner onto the recording material S was printed.

(Step 4) After the printing, the density of contamination toner Tc discharged onto the recording material S was measured with a densitometer (X-Rite 504 manufactured by X-Rite, Incorporated. Measurement mode: Status-I).

(Step 5) After step 4 was completed, the heating film 16 was removed from the fixing device F1 to measure the amount of contamination toner Tc remaining on the heating film 16.

A cellophane adhesive tape (Nichiban CT-18) was affixed to the surface of the heating film 16 to which contamination toner Tc was attached, and then the cellophane adhesive tape was removed together with the contamination toner Tc attached thereto. The contamination toner Tc attached to the cellophane adhesive tape was measured with a densitometer (X-Rite 504 manufactured by X-Rite, Incorporated. Measurement mode: Status-I). An image T printed in step 1 was a text pattern in which seven lines of 12-point characters were printed using each of yellow toner (Y toner), magenta toner (M toner), cyan toner (C toner), and black toner (K toner). The printing ratio of each of the colors was 1%. Each of the top, bottom, right, and left margins was set to 5 mm. In the experiment, commonly-used A4-size (width 210 mm, length 297 mm) printing sheets for laser beam printers (LBP) with a grammage of 80 g/m$^2$ were used.

Figure 6:
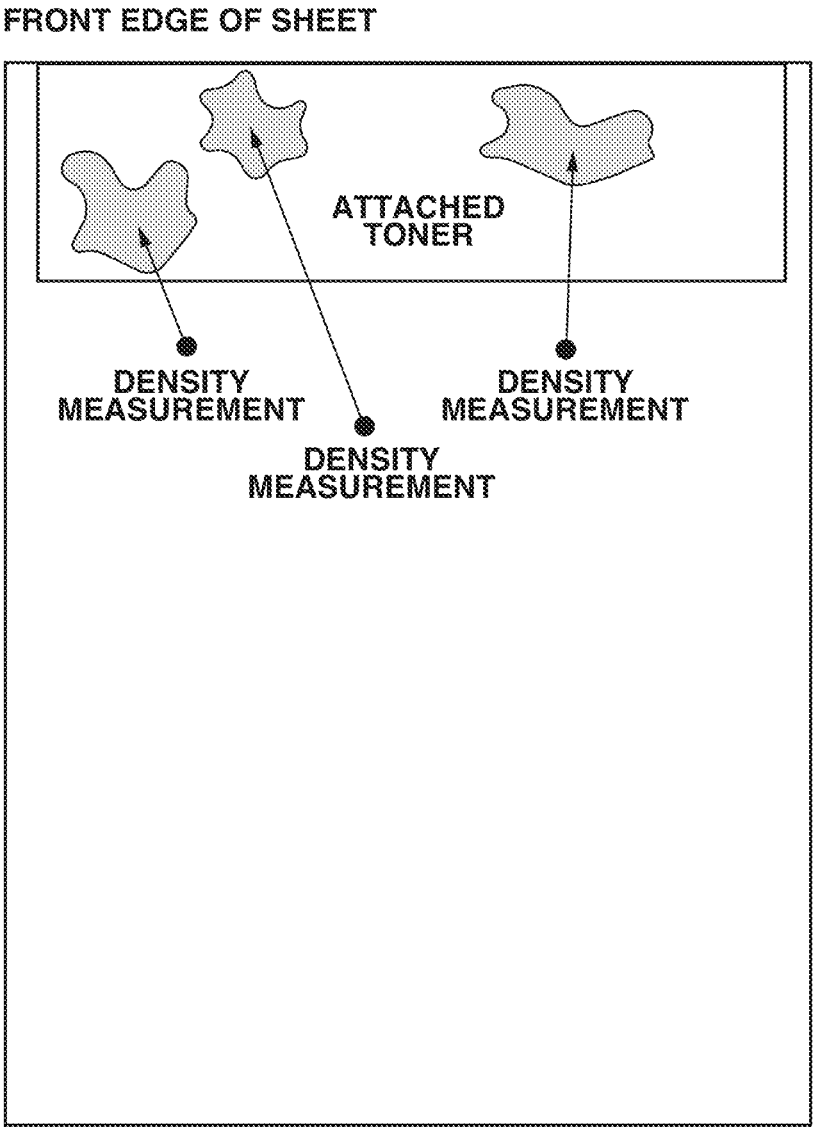
FIG. 6 illustrates density measurement positions in steps 3 and 4 in a first experiment.

The target temperature in the cleaning step in step 2 was changed and the experiment was conducted. The experiment was conducted under the conditions with the target temperatures of 200° C., which was the same as the target temperature in the fixing processing step, and 210° C., 220° C., and 230° C., which were higher than the target temperature in the fixing processing step. After step 3 was completed, toner was attached to the printed recording material S as illustrated in FIG. 6. In step 4, a plurality of points at which the toner was attached to the recording material S was measured, and portions with the highest density were measured.

Figure 7A:
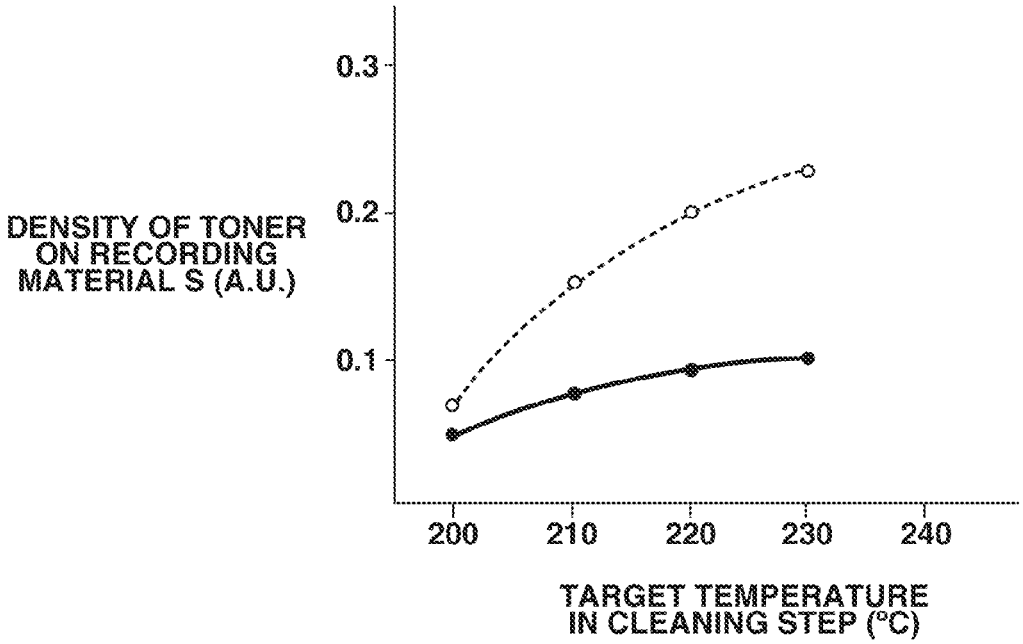
FIG. 7A illustrates a relationship between a target temperature in a cleaning step and toner density on a recording material.
Figure 7B:
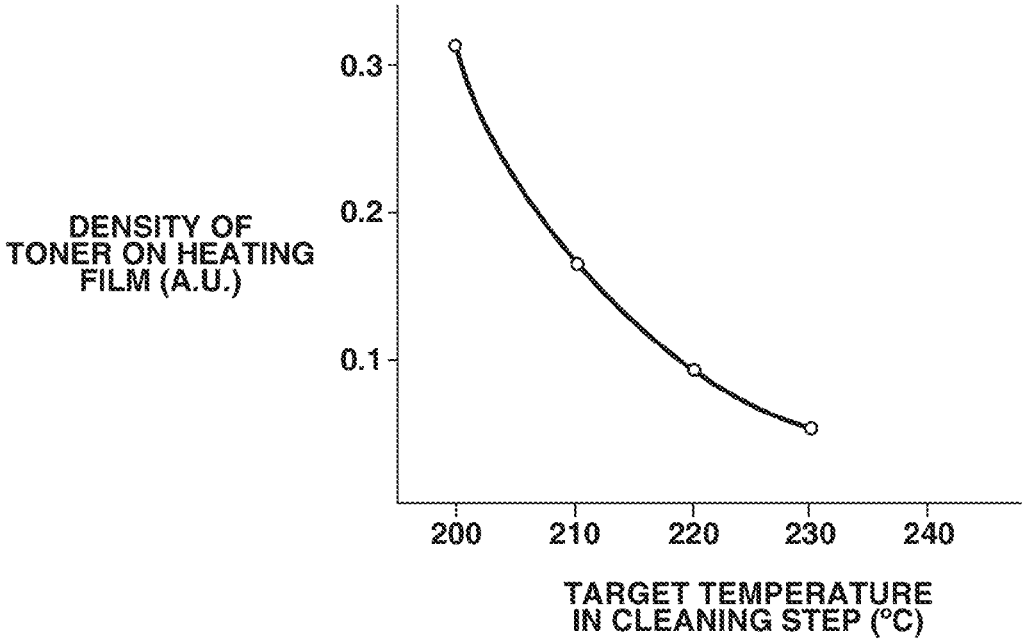
FIG. 7B illustrates a relationship between the target temperature in the cleaning step and toner density on a heating film.

FIGS. 7A and 7B show the results of the experiment conducted by performing the foregoing steps. FIG. 7A is a graph showing the amounts of discharge on the recording materials S that were measured in step 4 of the experiment. The abscissa axis of the graph shows the target temperatures of the fixing device F1 in the cleaning step, and the ordinate axis shows the densities of toner attached on the recording materials S in the cleaning step. A solid line shows the results of measurement of densities on the front sides of the recording materials S, and a dotted line the results of measurement of densities on the back sides of the recording materials S. In the experiment, the densities of toner attached on the recording materials S were higher at higher target temperatures. Especially the toner densities on the back sides of the recording materials S were more likely to exhibit this characteristic.

FIG. 7B is a graph showing the measured values of the densities of the toner attached on the heating film 16 that were measured in step 5. The abscissa axis of the graph shows the target temperatures in the cleaning step, and the ordinate axis shows the densities of toner remaining on the heating film 16 after the completion of the cleaning step. The densities of toner remaining on the heating film 16 were lower at higher target temperatures. In the present exemplary embodiment, the target temperature in the cleaning step was set to 230° C. (T2), which was higher than the target temperature in the fixing processing step.

Second Experiment

The length of time of the cleaning step in step 2 was changed step by step, and an experiment was conducted using the same image forming apparatus P and the same fixing device F1 as those used in the first experiment. The target temperature was fixed to 230° C., and the experiment was conducted under the conditions with the length of time of idle rotation of 0 seconds, 5 seconds, and 10 seconds. The rest of the steps of the experiment were the same as those in the first experiment. As used herein, the idle rotation time of 0 seconds indicates that no idle rotation was executed.

Figure 8A:
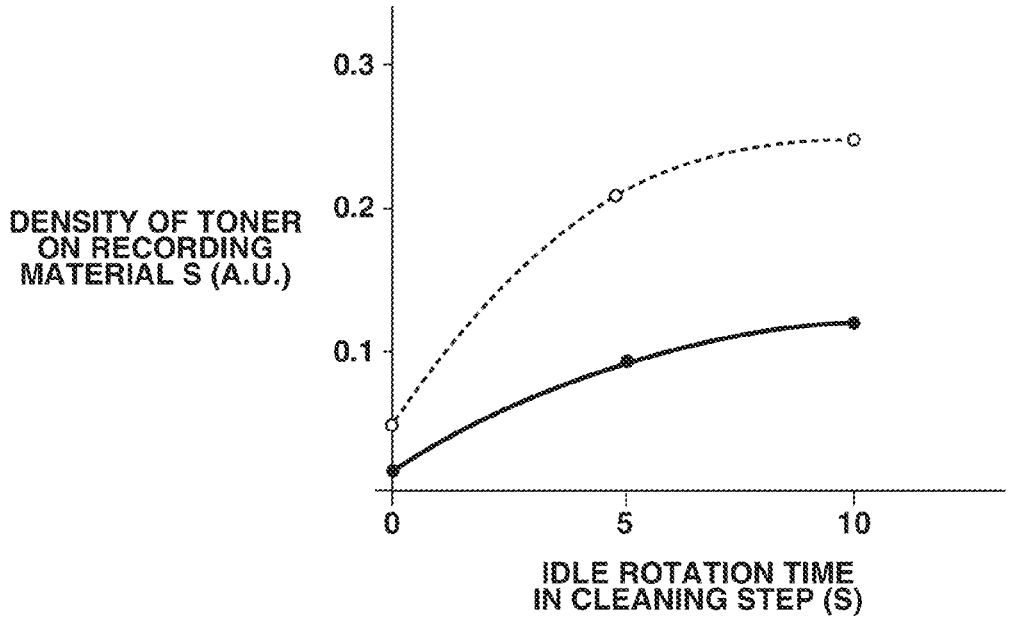
FIG. 8A illustrates a relationship between idle rotation time in the cleaning step and the toner density on the recording material.
Figure 8B:
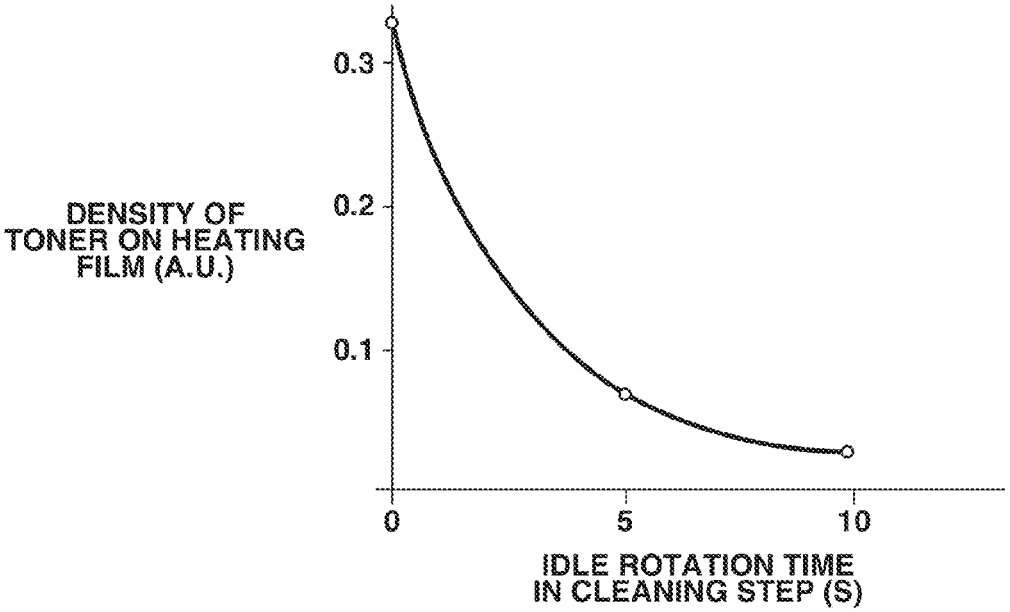
FIG. 8B illustrates a relationship between the idle rotation time in the cleaning step and the toner density on the heating film.

FIGS. 8A and 8B illustrate the results of the second experiment. FIG. 8A is a graph illustrating the densities of toner attached to the recording materials S that were measured in step 4 in the second experiment. The abscissa axis of the graph shows the length of time of idle rotation in the cleaning step, and the ordinate axis shows the density of toner attached on the recording material S after the completion of the cleaning step. A solid line shows the results of measurement of densities on the front surfaces of the recording materials S, and a dotted line the results of measurement of densities on the back surfaces of the recording materials S. FIG. 8B is a graph illustrating the values of the densities of the toner attached on the heating film 16 that were measured in step 5 in the second experiment. The abscissa axis of the graph shows the length of time of idle rotation in the cleaning step, and the ordinate axis shows the density of toner remaining on the heating film 16 after the cleaning step.

Referring to FIGS. 8A and 8B, the density of the toner on the recording material S increased and the density of the residual toner remaining on the heating film 16 decreased at longer lengths of time of the cleaning step. The reason is as follows. As the density of the toner attached to the recording material S increased, the density of the toner attached to the heating film 16 decreased. The contamination toner accumulated on the heating film 16 in the continuous printing in step 1 was transferred to the fixing roller 30 and the pressing film 51 in the cleaning step in step 2 and fixed to a recording material S during the subsequent printing. From the foregoing, it can be understood that the cleaning effect on the heating film 16 increases at higher target temperatures and longer lengths of time of idle rotation in the cleaning step.

Figure 9:
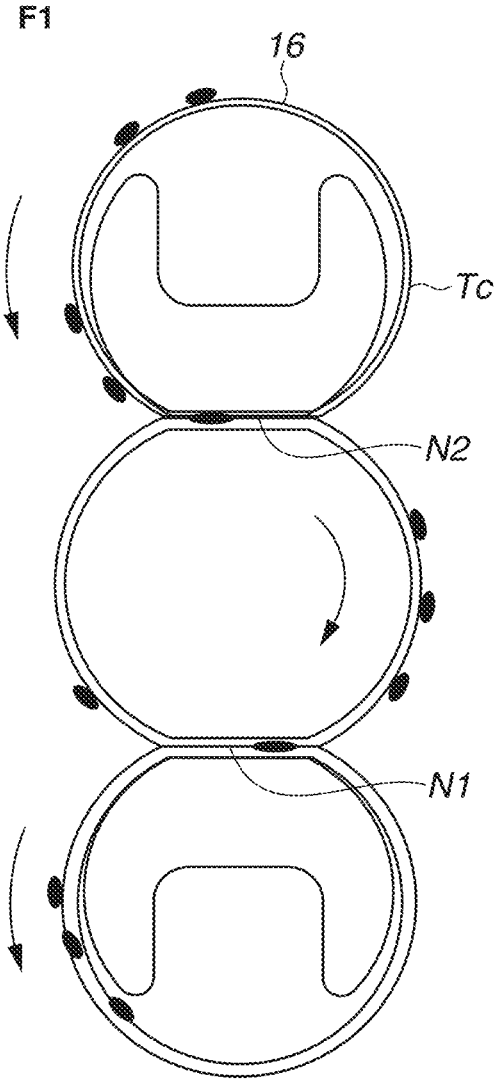
FIG. 9 illustrates a path through which contamination toner on the heating film is detached at a heating nip portion and transferred to a fixing roller.

The following describes the mechanism in which the contamination toner Tc on the surface of the heating film 16 is transferred onto the surface of the fixing roller 30 and then further transferred onto the surface of the pressing film 51 in the cleaning step, with reference to FIG. 9. When heat is applied, toner containing a resin as a main component is softened and easily adheres to a component with which the toner is in contact. If the temperature is further increased, the toner is melted, and the cohesion force of the toner decreases. This causes the toner to be removed easily from the member with which the toner is in contact.

As the heating film 16 is rotated, the contamination toner Tc attached to the surface of the heating film 16 reaches the heating nip portion N2. At the heating nip portion N2, the contamination toner Tc is sandwiched between the heating film 16 and the fixing roller 30 and heated from the heating film 16 side. At the heating nip portion N2, if the contamination toner Tc is excessively heated and melted by the heating film 16, cohesive failure is likely to occur at the interface, and the contamination toner Tc is easily removed from the heating film 16. Similarly, at the contact surface of the fixing roller 30 and the contamination toner Tc, when the contamination toner Tc is heated, the contamination toner Tc is softened and is firmly attached to the fixing roller 30. At the interface between the surface of the heating film 16 and the contamination toner Tc, the contamination toner Tc is melted and the cohesion force is low, compared to the interface between the surface of the fixing roller 30 and the contamination toner Tc. Due to a difference in cohesion forces of the toner on the interfaces, the contamination toner Tc is transferred from a higher temperature side to a lower temperature side. The larger the difference between the temperature of the surface of the heating film 16 and the temperature of the surface of the fixing roller 30 is, the more the contamination toner Tc is likely to be transferred. By a similar mechanism, the contamination toner Tc transferred onto the fixing roller 30 is further transferred to the pressing film 51 having a lower temperature. The contamination toner Tc is transferred from the fixing roller 30 to the front surface of the recording material S and further from the pressing film 51 to the back surface of the recording material S and then fixed as contamination toner.

In the fixing processing step as well as in the cleaning step, the toner melted on the surface of the heating film 16 is discharged from the heating film 16 via the fixing roller 30. However, as the contamination toner Tc attached to the surface of the heating film 16 is melted on the surface of the heating film 16, wax components and low-molecular-weight components volatilize, and the contamination toner Tc becomes less likely to melt than the toner T on the recording material S and consequently has a high melting point.

The contamination toner Tc becomes less likely to melt at the target temperature of the heater 15 in the fixing processing and may accumulate on the heating film 16. The target temperature in the cleaning step may be set higher than the target temperature in the fixing processing step so that a large amount of heat can be applied as long as possible to the contamination toner Tc accumulated on the heating film 16. There may be a case where the contamination toner Tc is accumulated on the heating film immediately after the completion of the fixing processing step. However, if a larger amount of heat is applied to the contamination toner Tc in the cleaning step, the cohesion force between the toners is reduced and thereby the contamination toner Tc can be easily removed from the heating film 16. The target temperature in the cleaning step is set higher than the target temperature in the fixing processing step, and a larger difference between the target temperatures leads to a greater cleaning effect. However, a surface layer of the fixing roller 30 and a surface layer of the heating film 16 may deteriorate and the contamination toner Tc may adhere thereto, so the target temperature in the cleaning step is desirably set to be equal to or lower than the withstanding temperature limits of the members.

Third Experiment

A third experiment was conducted to compare a cleaning effect of an arrangement of the present exemplary embodiment on the heating film 16 to a cleaning effect of an arrangement of a comparative example on the heating film 16. In the arrangement of the present exemplary embodiment, the cleaning steps in the first and second experiments are incorporated into a print job. In the arrangement of the comparative example, a cleaning operation is performed after a print job is completed.

In the present exemplary embodiment, one print job includes the image forming step, the fixing processing step, and the cleaning step, and the cleaning step is executed following the fixing processing step. This can shorten the elapsed time between the timing of completion of the fixing processing step (the timing at which the sheet discharge sensor 41 detects the passing of the last recording material) and the start of the cleaning step. In the present exemplary embodiment, the cleaning step is started simultaneously with the completion of the fixing processing step, so that the elapsed time is 0 seconds.

Figure 19:
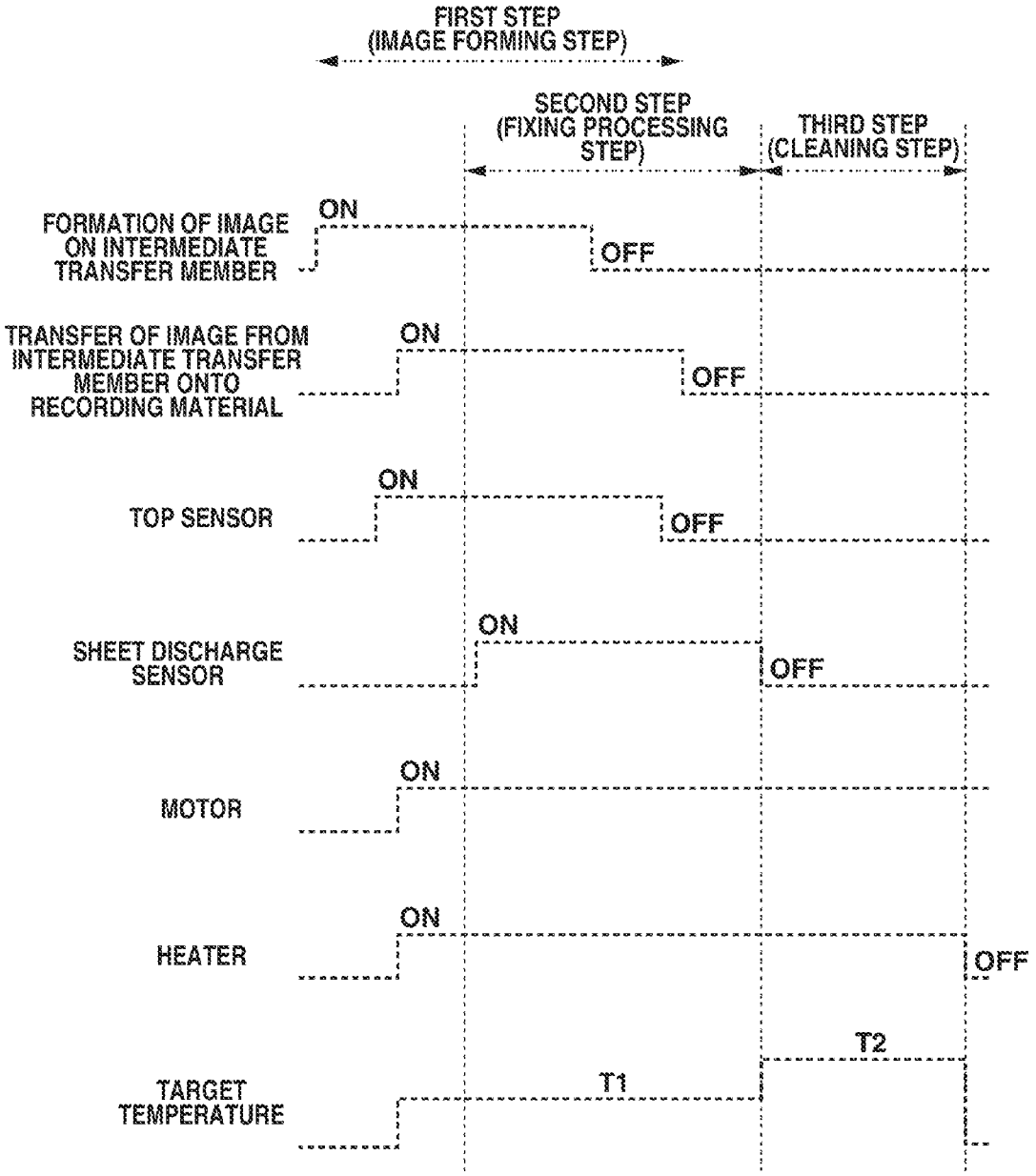
FIG. 19 is a timing chart illustrating the image forming step, the fixing processing step, and the cleaning step according to the first exemplary embodiment.

FIG. 19 illustrates a timing chart of the image forming step, the fixing processing step, and the cleaning step in the present exemplary embodiment.

The image forming step is the step up to the completion of the primary transfer in which an unfixed toner image is transferred from the photosensitive drum 4 to the intermediate transfer belt 9 and the second transfer in which the unfixed toner image is transferred from the intermediate transfer belt 9 to the recording material S.

The fixing processing step is the step from the entry of a front edge of the first recording material S into the nip portion N1 to the detection of the passing of a rear edge of the last recording material S of the print job through the sheet discharge sensor 41. In the fixing processing step, when a motor M configured to drive the fixing roller 30 is driven, power is supplied to the heater 15. Further, in the fixing processing step, power is supplied to the heater 15 such that the detected temperature of the thermistor 18 matches the target temperature (T1) in the fixing processing. The driving of the motor M and the supply of power to the heater 15 are started before the entry of a front edge of the first recording material S of a print job into the nip portion N1.

The timing of the start of the cleaning step is the timing at which the passing of a rear edge of the last recording material S of the print job is detected by the sheet discharge sensor 41. Simultaneously with the start of the cleaning step, the target temperature is changed to the target temperature (T2) in the cleaning, which is higher than the target temperature (T1) in the fixing processing, and the cleaning step is started. The cleaning step is completed at the time point at which the supply of power to the heater 15 is stopped.

On the other hand, in the comparative example, one print job includes the image forming step and the fixing processing step, and after the fixing processing step is completed, idle rotation of the fixing roller 30 is conducted in a state where the supply of power to the heater 15 is stopped. Then, the print job is completed. The cleaning step is executed after the completion of the print job. Hereinafter, the cleaning step that is executed after the completion of a print job as in the comparative example will be referred to as a cleaning operation in order to distinguish the cleaning step from the cleaning step of the present exemplary embodiment that is incorporated in a print job. Further, for comparison with the present exemplary embodiment, the timing of the start of the cleaning operation is defined in the comparative example using as a reference timing the timing at which the passing of the last recording material S of the previous print job is detected by the sheet discharge sensor 41. In a first comparative example, the elapsed time from the reference timing to the timing of the start of the cleaning operation is 180 seconds. In a second comparative example, the elapsed time is 600 seconds. In each of the present exemplary embodiment and the first and second comparative examples, the target temperature in the cleaning step (operation) is 230° C., and the idle rotation time is 5 seconds.

Figure 10A:
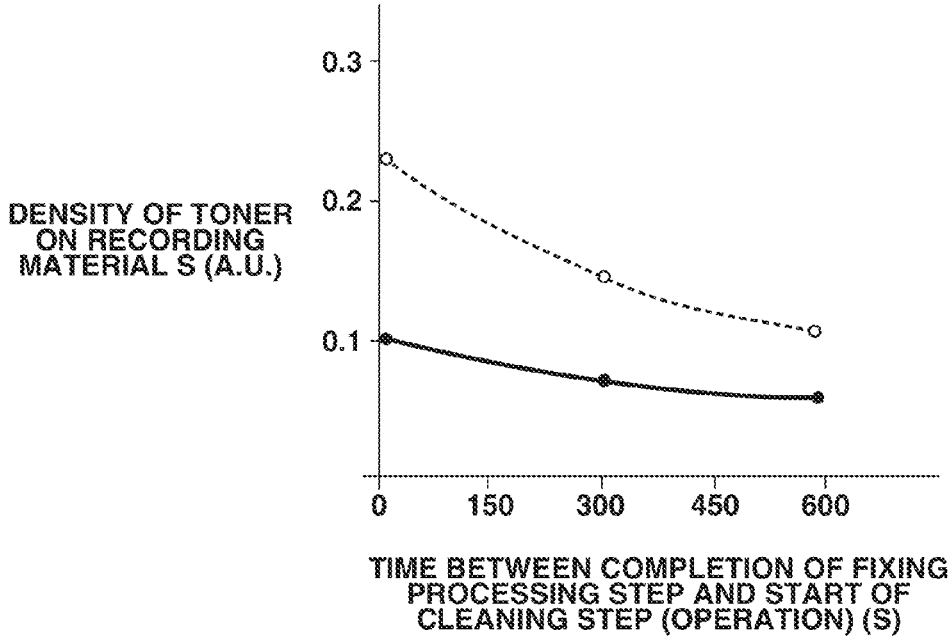
FIG. 10A illustrates a relationship between time from a completion of a fixing processing step to a start of the cleaning step and the toner density on the recording material.
Figure 10B:
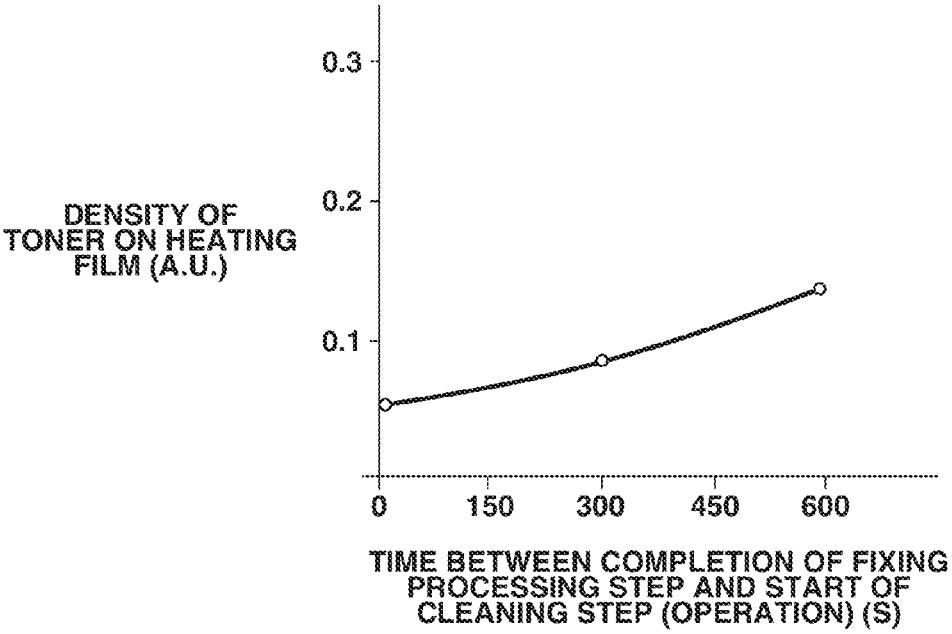
FIG. 10B illustrates a relationship between time from the completion of the fixing processing step to the start of the cleaning step and the toner density on the heating film.

The following describes the results of the third experiment with reference to FIGS. 10A and 10B. FIG. 10A is a graph showing the densities of toner attached on the recording materials S that were measured in step 4 in the third experiment. The abscissa axis of the graph shows the time elapsed until the start of the cleaning step or operation, and the ordinate axis shows the density of toner attached on the recording material S after the completion of the cleaning step or operation. In FIG. 10A, a solid line shows the results of measurement of densities on the front surface of the recording material S, and a dotted line shows the results of measurement of densities on the back surface of the recording material S. FIG. 10B is a graph showing the values of densities of toner attached on the heating film 16 that were measured in step 5 in the third experiment. The abscissa axis of the graph shows the time elapsed until the start of the cleaning step or operation, and the ordinate axis shows the density of toner remaining on the heating film 16 after the cleaning sequence.

According to FIG. 10A, the amount of contamination toner Tc discharged from the heating film 16 to the recording material S increased when the elapsed time until the start of the cleaning step or operation is shorter, and the amount of contamination toner Tc in the present exemplary embodiment is the largest. Further, from FIG. 10B it can be understood that the toner density on the heating film 16 decreased when the elapsed time is shorter, and that the toner density in the present exemplary embodiment is the lowest. In other words, FIG. 10B shows that the cleaning effect on the heating film 16 is the largest in the present exemplary embodiment.

Figure 11:
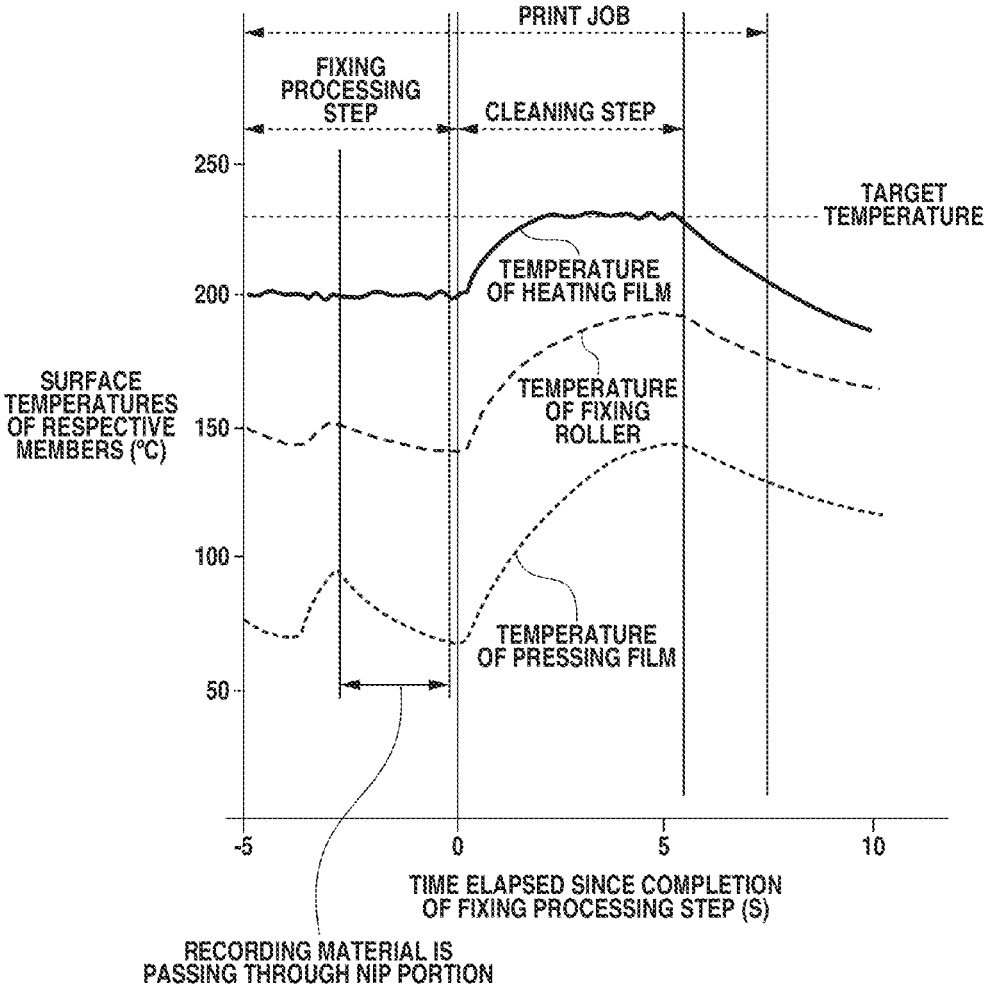
FIG. 11 illustrates a relationship between time elapsed since the completion of the fixing processing step and surface temperatures of respective members.
Figure 12A:
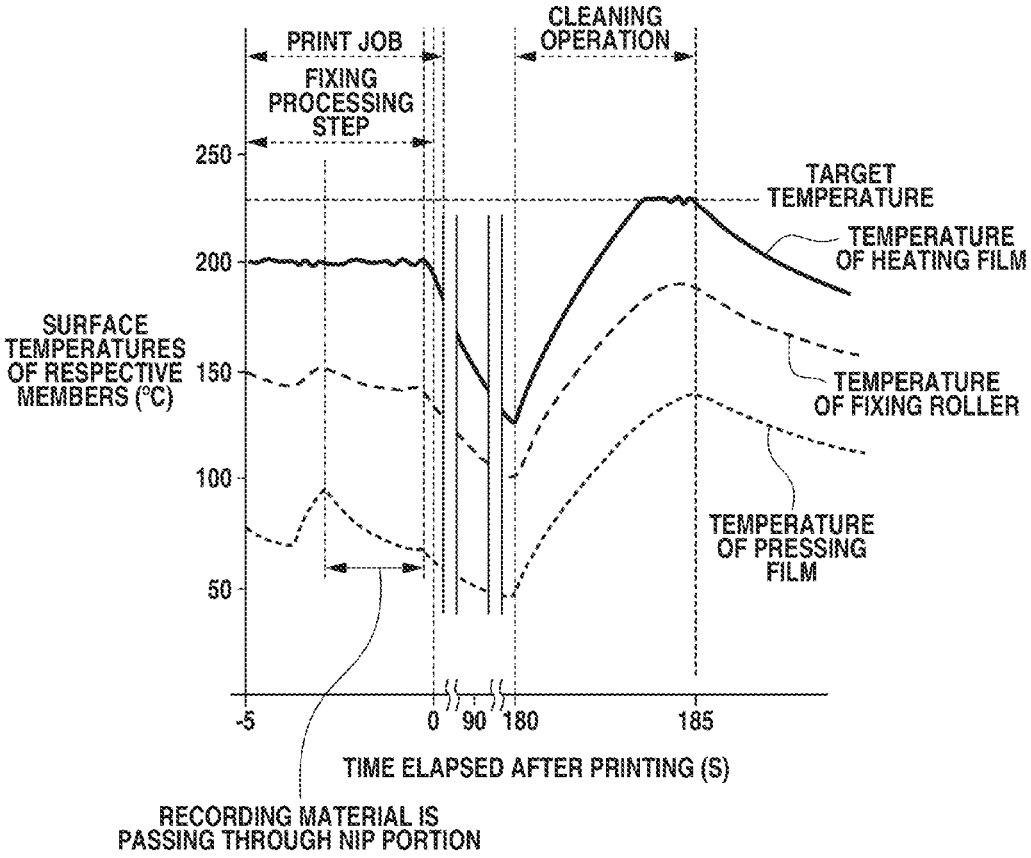
FIGS. 12A and 12B each illustrate a relationship between time elapsed after printing and surface temperatures of respective members.
Figure 12B:
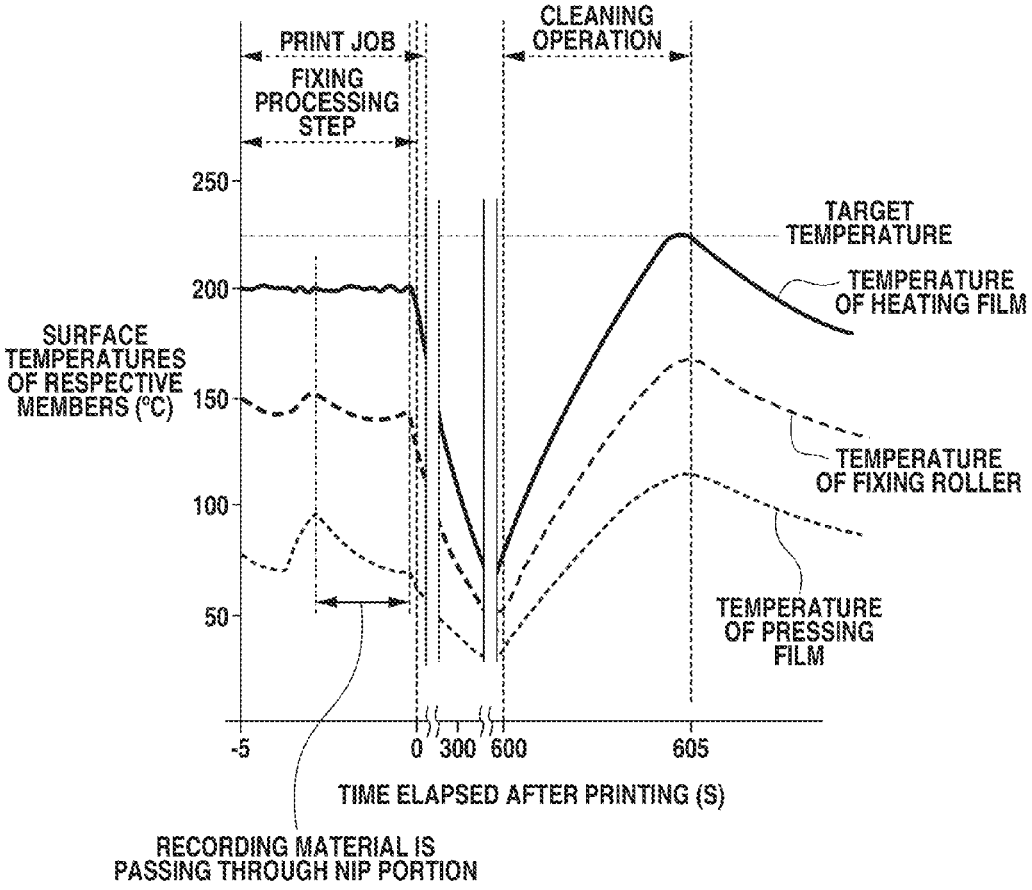

Next, to describe a mechanism by which the cleaning effect of the present exemplary embodiment is larger than the cleaning effects of the first and second comparative examples, changes in surface temperatures of the heating film 16, the fixing roller 30, and the pressing film 51 in the present exemplary embodiment and the first and second comparative examples after the completion of the fixing processing step were measured. FIGS. 11, 12A, and 12B show the changes in temperatures of the heating film 16, the fixing roller 30, and the pressing film 51 in the present exemplary embodiment and the first and second comparative examples, respectively. The abscissa axis in each of FIGS. 11, 12A, and 12B shows the elapsed time in a case where the time of completion of the fixing processing step is 0, and the ordinate axis shows the temperature. A solid line, a broken line, and a dotted line show the surface temperatures of the heating film 16, the fixing roller 30, and the pressing film 51, respectively.

Referring to FIG. 11, it can be understood that the surface temperature of the fixing roller 30 decreased during the fixing processing step in which the recording material was conveyed through the nip portion N1. The reason is that the heat of the surface of the fixing roller 30 was taken by the recording material S. On the other hand, the surface temperature of the heating film 16 decreased very little because the heater 15 was controlled such that the detected temperature matches the target temperature. Thus, in the case where the cleaning step is started following the completion of the fixing processing step as in the present exemplary embodiment, the cleaning step is started in the state in which a difference between the surface temperature of the heating film 16 and the surface temperature of the fixing roller 30 is large. As a result, the time during which the difference between the surface temperature of the heating film 16 and the surface temperature of the fixing roller 30 is large in the period (5 seconds) of the cleaning step increases.

On the other hand, in the first and second comparative examples, as illustrated in FIGS. 12A and 12B, the supply of power to the heater 15 is stopped after the fixing processing step is completed, and the fixing roller 30 is rotated predetermined times. Then, the print job is completed. After the completion of the print job, the cleaning operation is conducted. Thus, during the period in which the supply of power to the heater 15 is stopped after the completion of the fixing processing step, the surface temperature of the heating film 16 and the surface temperature of the fixing roller 30 decrease (the length of the elapsed time of 0 to 180 seconds in the first comparative example, and the length of the elapsed time of to 600 seconds in the second comparative example). Further, during the period, the heat of the heating film 16 is taken by the fixing roller 30 so that the difference between the surface temperature of the heating film 16 and the surface temperature of the fixing roller 30 gradually decreases. The cleaning operation is started in the state in which the temperature difference is small, so that the time during which the heating film 16 is maintained at the target temperature in the period (5 seconds) of the cleaning operation is shorter than that in the present exemplary embodiment. The time during which the heating film 16 is maintained at the target temperature is shorter in the second comparative example, in which the elapsed time is long, than in the first comparative example.

To maintain the heating film 16 at the target temperature and to adequately ensure the state in which a difference between the surface temperature of the heating film 16 and the surface temperature of the fixing roller 30 is large in the first and second comparative examples, the time of the cleaning operation may be increased. However, a longer cleaning operation time leads to a longer downtime to impair usability.

Fourth Experiment

An experiment was conducted to confirm the effect of the cleaning sequence according to the present exemplary embodiment. The experiment conditions were as follows. The process speed was 100 mm/s, and a conveyance interval between a preceding recording material S and a subsequent recording material S was 30 mm. The target temperature in the fixing processing step was 200° C. In the cleaning step, the target temperature was set to 230° C., and idle rotation of the fixing roller 30 was conducted for five seconds while power was supplied to the heater 15. After the completion of the cleaning step, the supply of power to the heater 15 was stopped, and idle rotation was conducted for three seconds. Then, the print job was ended.

Under an environment of an ambient temperature of 15° C. and a humidity of 15%, a print job of continuously printing on 10 sheets was repeated until the total reached 30K sheets. After the completion of the print job, there was a stand-by time of 10 seconds during which the supply of power to the heater 15 and the driving of the fixing roller 30 were stopped, and then the print job was executed again. This cycle was repeated. An image T to be printed was a text pattern in which 20 lines of 12-point characters were printed using each of Y toner, M toner, C toner, and Bk toner. The printing ratio of each of the colors was 1%.

An image forming apparatus A configured to perform the cleaning sequence was prepared as an image forming apparatus according to the present exemplary embodiment, and an image forming apparatus B configured not to perform the cleaning sequence was prepared as an image forming apparatus according to the comparative example.

In the image forming apparatus A according to the present exemplary embodiment in which the cleaning sequence was conducted, no contamination toner Tc was attached to the surface of the heating film 16 even after printing was performed on 30000 sheets.

On the other hand, in the image forming apparatus B according to the comparative example in which no cleaning sequence was conducted, after printing was performed on 3000 sheets, fixing failure started occurring in fixed toner images on printed recording materials S. The inside of the fixing device was checked, and contamination toner attached to the surface of the heating film 16 was observed.

Thus, in the present exemplary embodiment, the cleaning step is incorporated into the print job so that a transition to the cleaning step can be made promptly following the completion of the fixing processing step in a state where the temperature of the heating film 16 is high. Consequently, the state in which the cleaning effect is large (the state in which a difference between the surface temperature of the heating film 16 and the surface temperature of the fixing roller 30 is large) can be obtained promptly. From the foregoing, the present exemplary embodiment produces an advantage that the cleaning effect can be increased while the cleaning time of the heating film 16 is shortened.

The configuration of the fixing device F1 is not limited to the configuration described in the present exemplary embodiment. For example, the external heating member may be a film or roller containing a halogen heater. Further, the pressing member may be a roller including a core metal and a rubber layer.

Figure 13:
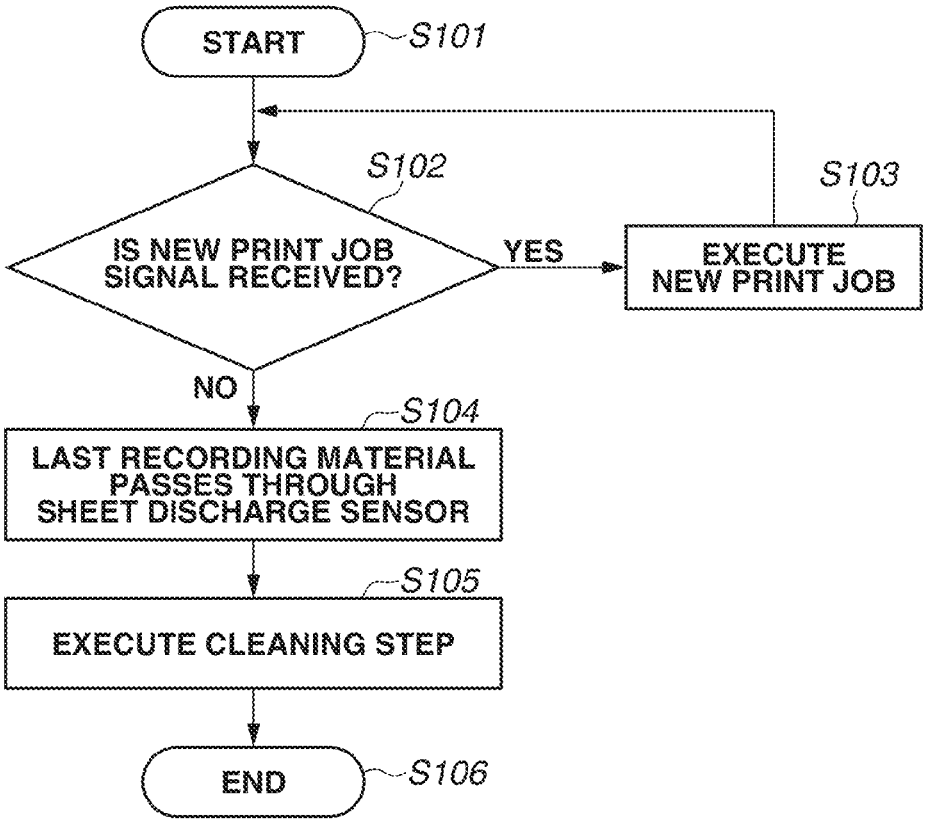
FIG. 13 is a flow chart illustrating a sequence of determination of whether to execute the cleaning step according to the first exemplary embodiment.

The following describes a sequence for preventing downtime caused by execution of the cleaning step. To prioritize usability, the cleaning step according to the present exemplary embodiment is set not to be executed depending on the conditions. The following describes the sequence with reference to a flow chart illustrated in FIG. 13. In step S101, a print job is started. If a new print job signal is received before the last recording material passes through the sheet discharge sensor 41 in step S104 (YES in step S102), the current print job is ended without execution of the cleaning step, and then in step S103, the new print job is executed. On the other hand, if no new print job signal is received (NO in step S102), then in step S105, the cleaning step is executed, and in step S106, the print job is ended. In a case where the cleaning step is executed less frequently, the amount of contamination toner Tc that is temporarily accumulated on the heating film 16 increases, but the downtime caused by execution of the cleaning step can be decreased.

Figure 14:
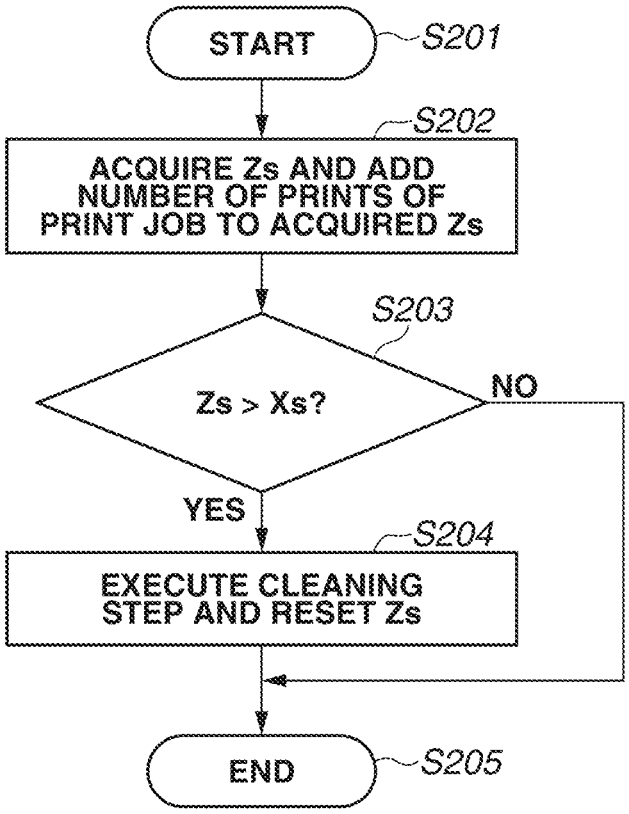
FIG. 14 is a flow chart illustrating a sequence of determination of whether to include the cleaning step based on an accumulated number of prints.

The following describes a sequence in which whether to include the cleaning step in a print job is determined based on whether the accumulated number of prints that is obtained by summation of the number of recording materials on which the fixing processing has been performed by the fixing unit has reached a predetermined number, with reference to a flow chart illustrated in FIG. 14. In step S201, a print job is started. In step S202, an integrated count Zs up to the previous print job is acquired, and the number of prints of the current print job is added to the integrated count Zs. If no new print job signal is received before the last recording material of the print job passes through the sheet discharge sensor 41, then in step S203, the integrated count Zs is compared to a threshold value Xs. If the integrated count Zs is larger than the threshold value Xs (YES in step S203), then in step S204, the cleaning step is executed and the integrated count Zs is reset. Then, in step S205, the print job is ended. On the other hand, if the total count Zs is smaller than the threshold value Xs (NO in step S203), then in step S205, the print job is ended without execution of the cleaning step. While the accumulated number of prints does not reach the predetermined number, the cleaning step incorporated in the print job is not executed, whereby the downtime is reduced and the usability improves.

An experiment was conducted to examine the effect of the cleaning sequence. The image forming apparatus used in the experiment was similar to the image forming apparatus used in the fourth experiment. An image forming apparatus C configured to execute the cleaning operation periodically was prepared as the image forming apparatus according to the present exemplary embodiment. In the image forming apparatus C, the cleaning sequence is executed if the integrated count Zs exceeds 250. As the print job, the cleaning step was executed in which the target temperature was 240° C. and idle rotation was conducted for 10 seconds, and 15 seconds after the supply of power to the heater 15 was stopped after the completion of the cleaning step, the rotational driving of the fixing device F1 was stopped to end. A print job of continuously printing ten recording materials was repeated until the total number of recording materials reached 30000. In the image forming apparatus C according to the present exemplary embodiment in which the cleaning sequence was periodically conducted, no contamination toner Tc was attached to the surface of the heating film 16 even after printing was performed on 30000 sheets.

In a case where cleaning is prioritized, the cleaning step may be conducted in every print job regardless of the present exemplary embodiment.

The following describes a second exemplary embodiment. The basic configuration of an image forming apparatus to which the present exemplary embodiment is applied is similar to the configuration according to the first exemplary embodiment, so elements that are similar to those in the first exemplary embodiment are given the same reference numerals, and description thereof is omitted.

A feature of the image forming apparatus according to the present exemplary embodiment is that the target temperature and the time of the cleaning step are changed depending on the number of recording materials to be printed continuously in a print job (the number of sheets on which fixing processing is to be performed). The image forming apparatus according to the present exemplary embodiment includes an acquisition unit configured to acquire the number of recording materials to be printed continuously in a print job. Table 1 shows the target temperatures and the cleaning time of the cleaning step for each of Zones 1 to 4 set for the respective numbers of recording materials to be printed continuously in a print job. The target temperature in the fixing processing step in the present exemplary embodiment is 200° C. Each one of the target temperatures for Zones 1 to 4 is higher than the target temperature in the fixing processing step.

TABLE 1

| | Number of recording materials of print job | | | | |
|---|---|---|---|---|---|
| | | | | Zone 4 41 or larger | |
| | Zone 1 10 or smaller | Zone 2 20 or smaller | Zone 3 40 or smaller | Zone 4-A Zf ≤ 2 | Zone 4-B Zf ≥ 3 |
| Target temperature | 210° C. | 220° C. | 230° C. | 220° C. | 245° C. |
| Cleaning time | 1 second | 2 seconds | 3 seconds | 2 seconds | 10 seconds |

In the present exemplary embodiment, in the case of Zone 1 in which the number of recording materials to be printed continuously in a print job is small, the time of the cleaning step is set shorter and the target temperature is set lower than those in the other zones. In the case of Zone 2 in which the number of recording materials to be printed continuously in a print job is larger than that in Zone 1, the time of the cleaning step is set longer and the target temperature is set higher than those in Zone 1. Further, in the case of Zone 3 in which the number of recording materials to be printed continuously in a print job is larger than that in Zone 2, the time of the cleaning step is set longer and the target temperature is set higher than those in Zone 2. In Zones 1 to 3, the larger the number of recording materials to be printed continuously is, the longer the time of the cleaning step is and the higher the target temperature is. In the present exemplary embodiment, 10, 20, and 40 are used as threshold numbers of recording materials.

The following describes the print job of Zone 4 in which the number of recording materials to be printed continuously is larger than that in Zone 3. In the print job of Zone 4, the following two cleaning steps are switched based on the number of times the print job of Zone 4 is continuously repeated. One of the two cleaning steps is a first cleaning step (Zone 4-A) in which print image quality is prioritized, and the other one is a second cleaning step (Zone 4-B) in which the discharge of contamination toner Tc is prioritized.

In the first cleaning step, contamination toner Tc is transferred little by little onto a recording material S in the normal print fixing processing step, whereby deterioration in the image quality due to transfer of a large amount of contamination toner Tc to a recording material S is prevented. Thus, in the first cleaning step, the target temperature is set lower than the target temperature in the cleaning step of Zone 3 to decrease the transfer amount of contamination toner Tc. Until the print job of Zone 4 is repeated twice consecutively, the first cleaning step is executed. While contamination toner Tc can be discharge only little by little in the first cleaning step, the first cleaning step is advantageous in that deterioration in the image quality can be prevented and no recording material S is used for the cleaning.

In the second cleaning step, as much contamination toner Tc accumulated on the heating film 16 as possible is transferred onto a recording material S, whereby the cleaning effect on the heating film 16 is maximized. Thus, in order to maximize the cleaning effect on the heating film 16, the cleaning time is set longer and the target temperature is set higher than those in Zone 3. The print image quality is not an issue because the recording material S is used for cleaning. The second cleaning step is executed in a case where the print job of Zone 4 is repeated three times or more. Specifically, the second cleaning step is executed in a case where further accumulation of contamination toner Tc on the heating film 16 is likely to form a large mass and drop onto a recording material S to impair image quality. Frequent execution of the second cleaning step can waste the recording material S and increase the downtime, so the second cleaning step is executed either periodically or upon instruction from the user. The second cleaning step is effective in a case where contamination toner Tc accumulated on the heating film 16 does not decrease, such as a case where the amount of accumulation is larger than the amount of contamination toner Tc that can be discharged in the first cleaning step.

Figure 15:
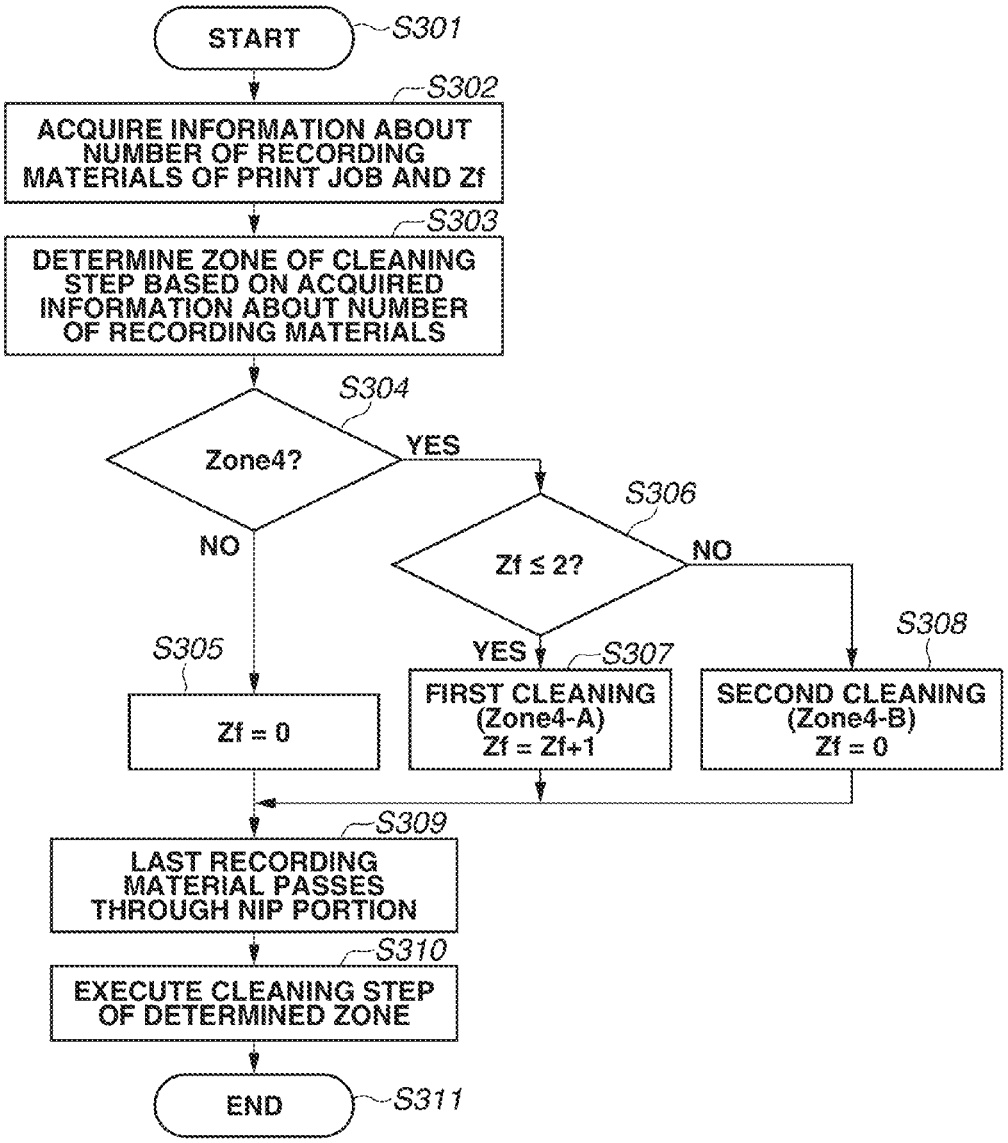
FIG. 15 is a flow chart illustrating a sequence of determination of a zone of the cleaning step.

FIG. 15 is a flow chart illustrating the cleaning sequence according to the second exemplary embodiment.

In step S301, a print job is started. In step S302, the acquisition unit acquires information about the number of recording materials of the print job and the number of continuously repeated cycles Zf of Zone 4. In step S303, one of Zones 1 to 4 is determined as the zone of the cleaning step based on the acquired information about the number of recording materials. In step S304, whether the determined zone is Zone 4 is determined. If the determined zone is Zone 4 (YES in step S304), then in step S306, whether the value of Zf is two or smaller is determined. If the value of Zf is two or smaller (YES in step S306), the first cleaning is determined, and then in step S307, one is added to the value of Zf acquired in step S302. On the other hand, if the value of Zf is not two or smaller (NO in step S306), the second cleaning is determined, and then in step S308, the value of Zf acquired in step S302 is set to 0 to reset the value of Zf. On the other hand, in step S304, if the determined zone is not Zone 4 (NO in step S304), the value of Zf acquired in step S302 is set to 0. Then, in step S310, the cleaning step of the zone determined after the last recording material of the print job passes through the nip portion in step S309 is executed, and then in step S311, the print job is ended.

An experiment was conducted to confirm the effect of the cleaning sequence according to the present exemplary embodiment. An image forming apparatus used in the experiment was similar to the image forming apparatus used in the first experiment. Further, a cleaning sequence is similar to the cleaning sequence in Table 1.

The experiment was conducted under four conditions in which the number of recording materials per print job was 10, 20, 40, and 100 and also a condition in which a print job of 100 sheets was repeated three times per print job. An image T was printed using 15% of the respective colors, which was 60% in total, on an entire surface, where the maximum amount of toner of each color was assumed to be 100%. Each of the top, bottom, right, and left margins was set to 5 mm. After the printing was completed under each of the conditions, one blank sheet was printed without forming a toner image in order to examine the discharge of contamination toner Tc. In the experiment, commonly-used A4-size (width 210 mm, length 297 mm) printing sheets for laser beam printers (LBP) with a grammage of 80 g/m$^2$ were used. After the printing was performed, the densities of toner discharged onto the recording materials S were measured with a densitometer (X-Rite 504 manufactured by X-Rite, Incorporated. Measurement mode: Status-I), and the results are shown in Table 2.

TABLE 2

| Experiment condition | 10 sheets | 20 sheets | 40 sheets | 100 sheets × 1 time | 100 sheets × 3 times |
|---|---|---|---|---|---|
| D | 0.08 | 0.11 | 0.17 | 0.13 | 0.42 |

If the density of the toner discharged on the recording material S is 0.20 or lower, the discharged toner is almost visually unrecognizable. Thus, it can be said that the toner has little effect on the print image quality.

In the present exemplary embodiment, the toner discharged on the recording material S under each of the conditions of 10 sheets, 20 sheets, 40 sheets, and 100 sheets×1 time was almost visually unrecognizable. Further, a large amount of contamination toner Tc was discharged on the recording material S under the condition of 100 sheets×3 times. In this condition, the discharge of contamination toner Tc was prioritized, and the recording material S was used for cleaning, so that no problem arises regarding image quality.

Next, the heating film 16 was removed from the fixing device F1 by the following step, and the amount of contamination toner Tc remaining on the heating film 16 was measured. A cellophane adhesive tape (Nichiban CT-18) was affixed to the surface of the heating film 16 to which contamination toner Tc was attached, and then the cellophane adhesive tape was removed together with the contamination toner To attached thereto. The contamination toner To attached to the cellophane adhesive tape was measured with a densitometer (X-Rite 504 manufactured by X-Rite, Incorporated. Measurement mode: Status-I), and the results are shown in Table 3.

TABLE 3

| Experiment condition | 10 sheets | 20 sheets | 40 sheets | 100 sheets × 1 time | 100 sheets × 3 times |
|---|---|---|---|---|---|
| D | 0.07 | 0.08 | 0.08 | 0.25 | 0.09 |

Under each of the conditions of 10 sheets, 20 sheets, and 40 sheets, the density of contamination toner Tc remaining on the heating film 16 was not higher than 0.1. The contamination toner Tc was successfully discharged in each cleaning sequence. Under the condition of 100 sheets×1 time, the cleaning sequence in which image quality was prioritized was conducted, and a large amount of contamination toner Tc remained on the heating film 16. When a print job of continuously printing 100 sheets is repeated, contamination toner Tc is accumulated on the heating film 16, and if this is repeated three times, the cleaning sequence under the condition of 100 sheets×3 times is executed. Under the condition of 100 sheets×3 times, the density of contamination toner Tc remaining on the heating film 16 was not higher than 0.1, and it can be understood that the heating film 16 was sufficiently cleaned.

As described above, under the conditions of 10 sheets, 20 sheets, 40 sheets, and 100 sheets×1 time, the cleaning step with the temperature and time set appropriately to the amount of offset toner accumulated on the heating film 16 is executed in a case where printing is continuously performed on a plurality of recording materials. In this way, the heating film 16 can be cleaned while deterioration in print image quality is prevented. Further, excessive thermal damage on the fixing unit can be avoided, and the power consumption can be reduced. Further, the cleaning step under the condition of 100 sheets×3 times can handle a large amount of contamination toner Tc accumulated on the heating film 16 if the cleaning capability is maximized. The cleaning step under the condition of 100 sheets×3 times can prevent contamination toner Tc from forming a large mass and dropping onto a recording material S to cause a defective image.

The following describes a third exemplary embodiment. The basic configuration of an image forming apparatus to which the present exemplary embodiment is applied is similar to that in the second exemplary embodiment, so elements having functions and configurations that are similar or correspond to those in the first exemplary embodiment are given the same reference numerals, and detailed description thereof is omitted. A feature of the present exemplary embodiment is that the temperature and the time of the cleaning step are changed according to the density of a toner image to be printed. In a case where a large amount of images having a print density within a halftone region, in which offset to a fixing roller 30 is likely to occur and contamination toner Tc is likely to accumulate on a heating film 16, is continuously printed, the temperature of the cleaning step is set low and the time of the cleaning step is set short.

(Image Processing Unit)

Figure 16:
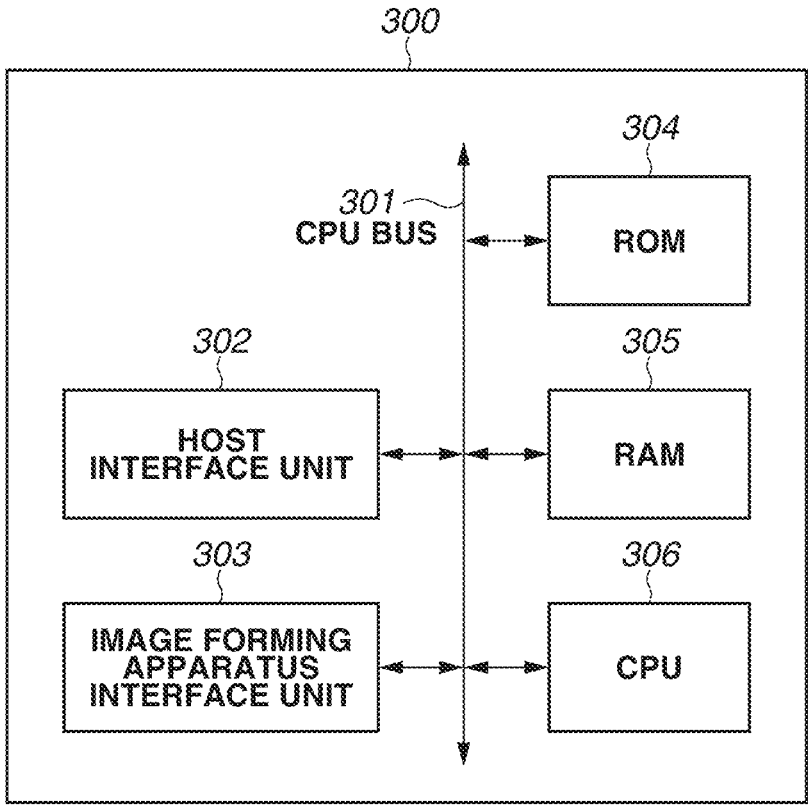
FIG. 16 is a block diagram illustrating a video controller.

The following describes a video controller 300, serving as an image processing unit, with reference to FIG. 16. The video controller 300 includes devices connected to one another via a CPU bus 301, such as a host interface unit 302, an image forming apparatus interface unit 303, a read-only memory (ROM) 304, a random access memory (RAM) 305, and a CPU 306. The CPU bus 301 includes address, data, and a control bus.

The host interface unit 302 has a function of bi-directionally connecting to and communicating with a data transmission apparatus such as a host computer via a network. The image forming apparatus interface unit 303 has a function of bi-directionally connecting to and communicating with an image forming apparatus P.

The ROM 304 holds control program codes for executing image data processing, which will be described below, and other processing. The RAM 305 is a memory configured to hold bitmap data acquired by rendering image data received by the image forming apparatus interface unit 303, image density information, a temporary buffer area, and statuses of various types of processing. The CPU 306 controls each of the devices connected to the CPU bus 301 based on the control program codes held in the ROM 304.

Figure 17:
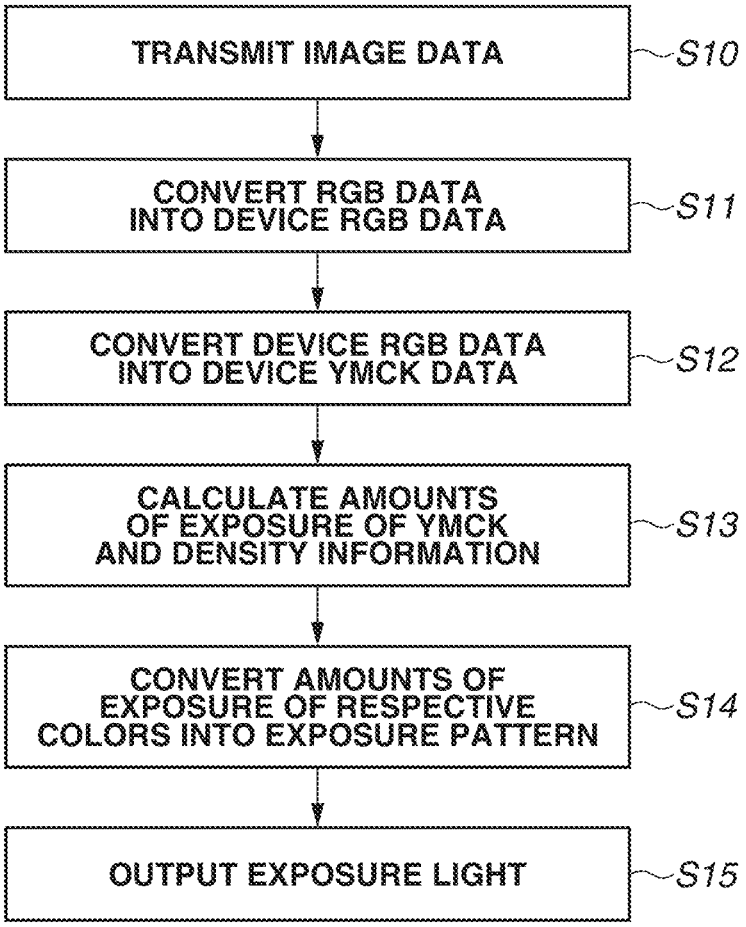
FIG. 17 is a flow chart illustrating a flow from an image data input to an exposure light output.

The following describes image data processing. FIG. 17 illustrates a flow of the image data processing. In step S10, image data together with the size of a recording material and a command such as an operation mode are transmitted as image information from the host computer. In a case where the image data is data on a color image, the color information is based on RGB (red, green, blue) data. In step S11, the color information on the respective colors is allocated and converted into device RGB data that is reproducible in the image forming apparatus. Then, in step S12, the color information of the image data is converted from the device RGB data into device YMCK (yellow, magenta, cyan, black) data. The YMCK data is defined as the ratio of the amount of toner to the amount of toner obtained on a recording material when all lasers of image forming stations of the respective colors are turned on, and the range is from 0 to 100%. The data value of 0% indicates a case where all the lasers are turned off and the amount of toner is 0. In step S13, the amounts of exposure of the respective YMCK colors are calculated with respect to the YMCK data using a gradation table showing the relationship between the amounts of exposure of the respective colors and the amounts of toner to be used.

In step S13, the image density is calculated based on the YMCK data. For example, in a case where image data on a certain pixel is Y=50%, M=70%, C=20%, and K=0%, the image density is 140% (=50+70+20+0). Then, in step S14, the amount of exposure of the respective colors is converted into an exposure pattern to be used for each pixel, and in step S15, exposure light is output.

Figure 18:
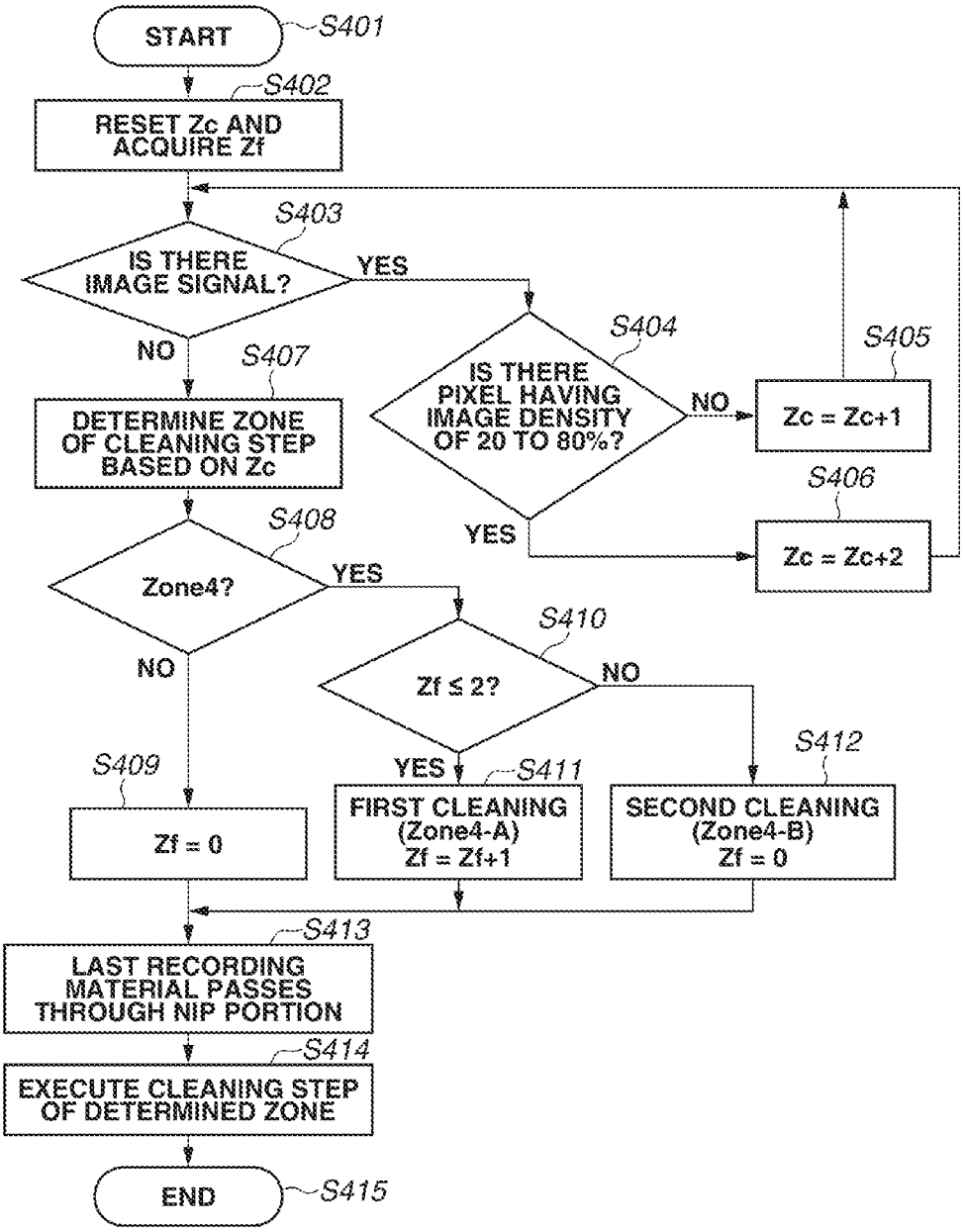
FIG. 18 is a flow chart illustrating a flow of determination of a zone of the cleaning step based on a number of sheets to be printed in a print job and density information.

The following describes a method of determining a cleaning step according to the present exemplary embodiment. FIG. 18 illustrates a flow chart in which whether to include the cleaning step is determined based on the number of recording materials to be printed continuously in a print job and the density information about each of the recording materials. In step S401, the image forming apparatus receives a print job and image formation is started. In step S402, the continuous print count Zc is reset, and the number of continuously repeated cycles Zf of Zone 4 is acquired. In step S403, while receiving image information, the video controller 300 transmits image signals for each page of the recording materials to the control unit 31. In step S404, each pixel of image information is detected to acquire density information, and whether there is a pixel having an image density in the range of 20% to 80% is determined. If there is no pixel having an image density in the range of 20% to 80% (NO in step S404), then in step S405, the control unit 31 adds one to the continuous print count Zc.

On the other hand, if there is a pixel having an image density in the range of 20% to 80% (YES in step S404), then in step S406, the control unit 31 adds two to the continuous print count Zc. If there is no image signal as a result that image signals of all the recording materials of the print job are transmitted to the control unit 31 (NO in step S403), then in step S407, the zone of the cleaning step is determined based on the value of the continuous print count Zc. The subsequent sequence (steps S408 to S415) is similar to the sequence (steps S304 to S311) in FIG. 15 according to the second exemplary embodiment, so description thereof is omitted.

The image forming apparatus according to the present exemplary embodiment determines the zone of the cleaning step based on not only the number of recording materials to be printed continuously in the print job but also the density information about the respective recording materials. In this way, the cleaning step that is more suitable for the amount of toner accumulated on the heating film 16 can be selected and executed than that in the second exemplary embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-080460, filed Apr. 9, 2015, which is hereby incorporated by reference herein in its entirety.

What is claimed is:

1. An image forming apparatus for forming a toner image on a recording material by executing print processing, the image forming apparatus comprising:

an image forming unit configured to form an unfixed toner image on the recording material;

a fixing unit configured to execute a fixing processing in which the recording material on which the unfixed toner image is formed is conveyed and heated at a nip portion to fix the unfixed toner image on the recording material, the fixing unit including a roller, a heating unit configured to be in contact with a first region of an outer surface of the roller to heat the roller, and a backup member configured to be in contact with a second region of the outer surface of the roller to form the nip portion, the second region being different from a first region in a rotating direction of the roller;

a temperature detection unit configured to detect a temperature of the heating unit; and a control unit configured to control power to be supplied to the heating unit so that the temperature detected by the temperature detection unit is maintained at a target temperature, wherein the print processing includes:

a first step in which the unfixed toner image is formed on the recording material by the image forming unit;

a second step in which the fixing processing is executed by the fixing unit with the target temperature which is a first temperature; and a third step executed following the second step, in which supplying the power to the heating unit with the target temperature which is a second temperature higher than the first temperature is executed while the roller is rotating in a state where no recording material is present at the nip portion.

2. The image forming apparatus according to claim 1, wherein the power is continuously supplied to the heating unit during a transition from the second step to the third step.

3. The image forming apparatus according to claim 1, wherein, in a case where the number of fixing processed recording materials in the second step exceeds a predetermined number, in the third step, at least one of a first setting and a second setting is made, the first setting being a setting in which the target temperature is higher than the target temperature in a case where the number of fixing processed recording materials in the second step does not exceed the predetermined number, the second setting being a setting in which a length of rotating time of the roller is longer than the length of rotating time of the roller in the case where the number of fixing processed recording materials in the second step does not exceed the predetermined number.

4. The image forming apparatus according to claim 3, wherein, in a case where the number of fixing processed recording materials in the second step exceeds a threshold number larger than the predetermined number, in the third step, at least one of a third setting and a fourth setting is made, the third setting being a setting in which the target temperature is lower than the target temperature in a case where the number of fixing processed recording materials in the second step does not exceed the threshold number but exceeds the predetermined number, the fourth setting being a setting in which the length of rotating time of the roller is shorter than the length of rotating time of the roller in a case where the number of fixing processed recording materials in the second step does not exceed the threshold number but exceeds the predetermined number.

5. The image forming apparatus according to claim 1, wherein whether to include the third step in the print processing is determined based on an accumulated number of prints which have been counted since the fixing unit was new.

6. The image forming apparatus according to claim 1, wherein the heating unit includes a cylindrical film.

7. The image forming apparatus according to claim 6, wherein the heating unit includes a heater configured to be in contact with an inner surface of the cylindrical film, the heater forming the nip portion together with the roller.

8. An image forming apparatus for forming a toner image on a recording material by executing print processing, the image forming apparatus comprising:

an image forming unit configured to form an unfixed toner image on the recording material;

a fixing unit including a nip portion, configured to execute a fixing processing in which the recording material on which the unfixed toner image is formed is conveyed and heated at the nip portion to fix the unfixed toner image on the recording material;

a temperature detection unit configured to detect a temperature of the fixing unit; and a control unit configured to control power to be supplied to the fixing unit so that the temperature detected by the temperature detection unit is maintained at a target temperature;

wherein the print processing includes:

a first step in which the unfixed toner image is formed on the recording material by the image forming unit;

a second step in which the fixing processing is executed by the fixing unit with the target temperature which is a first temperature; and a third step executed following the second step, in which supplying the power to the fixing unit with the target temperature which is a second temperature higher than the first temperature is executed while the roller is rotating in a state where no recording material is present at the nip portion.

9. The image forming apparatus according to claim 8, wherein the power is continuously supplied to the fixing unit during a transition from the second step to the third step.

* * * * *